US007568676B2

(12) United States Patent
Takagi et al.

(10) Patent No.: US 7,568,676 B2
(45) Date of Patent: Aug. 4, 2009

(54) FORM PANEL FOR PLACING CONCRETE

(75) Inventors: Senichi Takagi, Fukui (JP); Toshihiko Hosono, Saitama (JP); Toshiya Tanaka, Sabae (JP); Morihisa Otsuka, Nanjo-gun (JP); Michihiro Miyagoshi, Sakai-gun (JP); Satoru Mita, Osaka (JP); Kazuhiko Kise, Funabashi (JP)

(73) Assignee: Fukuvi Chemical Industry Co., Ltd., Fukui-ken (JP)

( * ) Notice: Subject to any disclaimer, the term of this patent is extended or adjusted under 35 U.S.C. 154(b) by 169 days.

(21) Appl. No.: 10/709,631

(22) Filed: May 18, 2004

(65) Prior Publication Data

US 2004/0200168 A1 Oct. 14, 2004

Related U.S. Application Data

(63) Continuation of application No. PCT/JP02/12321, filed on Nov. 26, 2002.

(30) Foreign Application Priority Data

Nov. 26, 2001 (JP) ..... P2001-360062
Mar. 15, 2002 (JP) ..... P2002-072643
Apr. 24, 2002 (JP) ..... P2002-122286

(51) Int. Cl.
*E04G 9/10* (2006.01)
*E04G 9/05* (2006.01)
*E04G 17/065* (2006.01)

(52) U.S. Cl. ..... 249/191; 249/44; 249/47; 249/192

(58) Field of Classification Search ..... 249/44, 249/47, 189, 190, 191, 192
See application file for complete search history.

(56) References Cited

U.S. PATENT DOCUMENTS 2,447,670 A * 8/1948 Rumble ..... 249/192
2,948,046 A * 8/1960 Imonetti ..... 249/196
3,137,909 A * 6/1964 Bonin et al. ..... 249/191

(Continued)

FOREIGN PATENT DOCUMENTS

DE 2747064 * 5/1979 ..... 249/192

(Continued)

OTHER PUBLICATIONS

Japanese Office Action for Application No. 2002-072643, mailed Jan. 8, 2008.

(Continued)

*Primary Examiner*—Michael Safavi
(74) *Attorney, Agent, or Firm*—Wood, Herron & Evans, L.L.P.

(57) ABSTRACT

The form panel for placing concrete of the present invention is a form panel (30) comprising a hollow sheathing section (32) made of plastic, one side of which forms a concrete placing surface (31), and hollow side panel sections (33) bent out at right angles from both side edges of the sheathing section (32) on an opposite side of the sheathing section (32) to the concrete placing surface (31), wherein projecting sections (40) which extend in a vertical direction are provided on an outside surface (38) of the side panel section (33), and one of the sides of one of the projecting sections (40) is coplanar with the concrete placing surface (31) of the sheathing section (32), and on the projecting sections (40), notches (41) are formed at respectively the same position and orthogonal to the longitudinal direction of the projecting sections (40). This type of form panel (30)allows the formwork fittings used with conventional plywood form panels to be used at the time of erection (installation), is lightweight and has good workability, is durable, does not easily leak concrete, and can be recycled.

7 Claims, 16 Drawing Sheets

U.S. PATENT DOCUMENTS

| | | | | | |
|---|---|---|---|---|---|
| 4,150,808 | A | * | 4/1979 | Sawyer | 249/191 |
| 4,210,304 | A | * | 7/1980 | Mannina | 249/189 |
| 4,211,385 | A | * | 7/1980 | Johanson et al. | 249/192 |
| 4,239,176 | A | * | 12/1980 | Salazar | 249/192 |
| 5,160,640 | A | * | 11/1992 | Badstieber | 249/189 |
| 5,375,810 | A | * | 12/1994 | Mathis | 249/192 |
| 5,431,366 | A | * | 7/1995 | Matsumoto et al. | 249/189 |
| 5,833,873 | A | * | 11/1998 | Adonetti | 249/47 |
| 6,283,439 | B1 | * | 9/2001 | Myers et al. | 249/47 |
| 6,742,758 | B2 | * | 6/2004 | Janesky | 249/192 |
| 6,874,749 | B2 | * | 4/2005 | Wells | 249/191 |

FOREIGN PATENT DOCUMENTS

| | | | | |
|---|---|---|---|---|
| FR | 2851638 | * | 8/2004 | 249/189 |
| JP | 06-101337 | | 4/1994 | |
| JP | 06129093 | | 10/1994 | |
| JP | 07-026494 | | 5/1995 | |
| JP | H07-127243 | | 5/1995 | |
| JP | 07207930 | | 8/1995 | |
| JP | H07-042840 | | 8/1995 | |
| JP | 07-279411 | | 10/1995 | |
| JP | 7-279411 | | 10/1995 | |
| JP | 3026839 | | 7/1996 | |
| JP | 8-333891 | | 12/1996 | |
| JP | 08-333891 | | 12/1996 | |
| JP | 9-151602 | | 6/1997 | |
| JP | 09-151602 | | 6/1997 | |
| JP | 09-177312 | | 7/1997 | |
| JP | 2636576 | | 7/1997 | |
| JP | 2636576 | B2 | 7/1997 | |
| JP | 11-182029 | | 7/1999 | |
| JP | 2000-008607 | | 1/2000 | |
| JP | 2000-017776 | | 1/2000 | |
| JP | 2001-018276 | | 1/2001 | |
| KR | 20-0121827 | | 5/1996 | |

OTHER PUBLICATIONS

Japanese Patent Office, Japanese Office Action in counterpart Japanese Application No. 2002-122286, Aug. 19, 2008, 6 pages.
Japanese Patent Office, Japanese Office Action in JP Patent Application No. 2002-122286, Apr. 22, 2008, 4 pgs.
Korean Patent Office, Korean Office Action in KR Patent Application No. 10-2004-7007873, Mar. 28, 2008, 10 pgs.

* cited by examiner

FORM PANEL FOR PLACING CONCRETE

This application is a continuation of PCT/JP02/12321, filed Nov. 26, 2002, which claims the priority of Japanese Patent No. 2002-122286, filed Apr. 24, 2002, Japanese Patent No. 2002-72643, filed Mar. 15, 2002, and Japanese Patent No. 2001-360062, filed Nov. 26, 2001, the disclosures of which are hereby incorporated herein by reference in the entireties.

TECHNICAL FIELD

The present invention relates to a plastic form panel for placing concrete, and relates specifically of a recyclable plastic form panel for placing concrete which allows the same fittings used in conventional plywood form panels comprising veneer plywood and the like, such as P-Cones and Form Ties (registered trademarks), to be used.

BACKGROUND ART

Conventionally, plywood form panels in which battens are nailed to the rear surface of a sheathing panel made of veneer plywood or the like, are commonly used as form panels for placing concrete they are low cost, can be nailed easily, and are lghtweight.

However, disadvantages of these plywood form panels are that (i) a nailing operation needs to be performed when securing the battens or connecting form panels, causing poor workability, (ii) the form panel is easily damaged by the nailing, and by concrete stripper applied to the front surface of the sheathing board, and as such can only be reused a limited number of times (approximately 5 times, for example), and (iii) form panels which can no longer be reused cannot be recycled as wood, and can only be dismantled and incinerated.

In order to solve the above problems, a recyclable plastic form panel which is lightweight and has good workability has been proposed.

FIG. 17 shows an example of such a plastic form panel. This form panel 10 comprises generally; a hollow sheathing section 12, one side of which forms a concrete placing surface 11, hollow side panel sections 13 bent out at right angles from both side edges of the sheathing section 12 on the opposite side of the sheathing section 12 to the concrete placing surface 11, and two hollow reinforcing panel sections 15 provided on a rear surface 14 of the sheathing section 12, which are parallel to the side panel sections 13. Here, the sheathing section 12, the side panel sections 13 and the reinforcing panel sections 15 are formed from hollow panels in which two panels 16 and a plurality of long reinforcing ribs 17 connecting these panels, are formed as an integrated unit.

The erection (installation) of this form panel 10 is described below with reference to FIG. 18.

First, a plurality of form panels 10 are lined up so that the outside surfaces 18 of the side panel sections 13 contact each other. Next, round separators 22 with P-Cones 21, which are clips for maintaining a predetermined gap between the opposing form panels 10, provided near both ends thereof, are passed through insertion holes 20 formed in the sheathing section 12 of the form panel 10.

Next, clamps 23 called Form Ties (registered trademark) are screwed onto the ends of these separators 22, and the form panel 10 s secured by sandwiching the sheathing section 12 between the P-Cone 21 on the separator 22 and a template 24 at the base end of the clamp 23.

In the same manner, another set of a plurality of form panels 10 are lined up with the separators 22 inserted through the insertion holes 20, so that the concrete placing surfaces 1 pose each other. The clamps 23 are then screwed onto the ends of the separators 22, and the form panel 10 is secured, by sandwiching the sheathing section 12 between the P-Cone 21 on the separator 22 and the template 24 at the base end of the clamp 23.

In addition, a pair of walers 25 made from square pipe steel are provided above and below the clamp 23, and are secured by a clip plate 26 and a wedge 27 which fastens the clip plate 26, so that the walers 25 are in contact with the sides of the side panel sections 13 and the reinforcing panel sections 15. These walers 25 are provided to ensure that the form panel 10 does not expand outward due to the pressure of the concrete when the concrete is placed.

However, because the sheathing section 12 of this form panel 10 is a hollow panel in which two thin panels 16 (of thickness approximately 2 mm) and reinforcing ribs 17 which connect between these panels are formed as an integrated unit, the strength of the panels 16 is not sufficient to withstand the pressure applied by the P-Cones 21 and the template 24 of the amp 23 provided at both sides of the sheathing section 12. Consequently, when formwork fittings which tend to concentrate pressure on a single point are used, such as the P-Cones 21 and the clamps 23 used with conventional plywood form panels, then the form panel 10 is easily damaged. For such reasons, the use of these conventional formwork fittings with plastic form panels is problematic, and it is necessary to use special fittings with a specific shape. Accordingly, the installation of plastic form panels in the configuration sown in FIG. 18 is difficult to achieve. Furthermore, the inability to use conventional formwork fittings has hindered the popularization of these plastic form panels.

Moreover, in order to prevent poured concrete from leaking outside the form panel 10 through gaps between the contacting portions of the side panel sections 13, the outside surface 18 of the side panel sections 13, which is the surface in contact with the adjacent form panel 10, must be flat. However, since the form panel 11 is a large scale molded product which is formed as an integrated unit by means of extrusion molding, it is difficult to ensure that the outside surface 18 of the side panel sections 13 is completely flat, and furthermore, sometimes sight deformations can occur in the side panel sections 13 later repeated use of the form panel 1.

A form panel in which horizontal insertion grooves are provided in the outside surface of the side panel sections, and the separators are passed through insertion holes formed when the insertion grooves from adjacent form panels face each other when the outside surfaces of the side panel sections are aligned, is disclosed in Japanese Unexamined Patent Application, First Publication No. 200-8607, as an example of a form panel in which it is not necessary to provide insertion holes for separators in the sheathing section.

However, for the same reasons as for the form panel 10 described above, in this form panel there is still a danger of the poured concrete leaking outside the form panel due to gaps occurring between e contacting portions of the side panel sections. Furthermore, a flaw of these arm panels is that because it is necessary to provide insertion grooves, the form panel cannot be hollow, and consequently it is difficult to reduce the weight of the form panel.

Moreover, because it is necessary to provide insertion grooves across the entire surface of the side panel sections, forming the insertion grooves is time consuming.

Accordingly, an object of the present invention is to provide a recyclable plastic concrete form panel which enables the use of the formwork fittings such as the P-Cones and Form Ties (registered trademark) used in the conventional plywood form panels made of veneer plywood or the like, is light and has high workability, is durable, and does not suffer from problems of concrete leakage.

DISCLOSURE OF INVENTION

A form panel for placing concrete of the present invention is a plastic form panel for placing concrete comprising hollow sheathing section, one side of which forms a concrete placing surface, and hollow side panel sections bent out at right angles from both side edges of the sheathing section on an opposite side of the sheathing section to the concrete placing surface, wherein at least one projecting section which extends in a vertical direction is provided on an outside surface of at least one of the side panel sections, and one of the sides of one of these projecting sections is coplanar with the concrete placing surface of the sheathing section. Such a form panel allows the formwork fittings used with conventional plywood form panels to be used, is lightweight and has good workability, is durable, does not easily leak concrete, and can be recycled. Furthermore, since projecting sections are provided on the side panel sections, the grooves can be formed more easily than in conventional form panels.

Moreover, in a form panel for placing concrete of the present invention, there is preferably more than one projecting section. If there are a plurality of projecting sections, any concrete which leaks out can collect in the space enclosed by the projecting sections and the side panel section, and concrete does not leak to outside the form panel.

Furthermore, in a form panel for placing concrete of the present invention, preferably two projecting sections which extend in a vertical direction are provided on an outside surface of at least one of the side panel sections, one of the sides of one of the projecting sections is coplanar with the concrete placing surface of the sheathing section, and the side of the other projecting section which faces the first projecting section is inclined. In such a form panel, insertion holes for inserting the separators can be provided easily and reliably in the contacting portions between the projecting sections, without any sideways deviation occurring.

Furthermore, in a form panel for placing concrete of the present invention, preferably the sheathing section and the side panel section are formed by integrating two panels and a plurality of long reinforcing ribs connecting these panels. The resulting form panel is lightweight, and has sufficient mechanical strength.

Moreover, preferably a diagonal rib which is diagonal relative to the concrete placing surface is formed within the projecting section, and in contact with an inside of a corner section on the concrete placing surface side. In a form panel for placing concrete which has such projecting sections, rounding of the corner sections of the projecting sections does not occur when the form panel is molded. Consequently when the form panels are erected, crevices (seams) do not appear where form panels are joined to each other, enabling the placed concrete surface to be kept flat.

Furthermore, in a form panel for placing concrete of the present invention, preferably the projecting sections are made of a soft resin or a semi hard resin. In such a form panel, it is even easier to form notches, and furthermore, gaps do not appear in the contacting portions of the projecting sections, further suppressing the leaking of concrete. Moreover, if flat separators are used there is no need to form the notches.

Furthermore, in a form panel for placing concrete of the present invention, preferably notches which are orthogonal to the longitudinal direction of the projecting sections are formed in the same position in each of the projecting sections. In a form panel employing this construction, the separators can be passed through the insertion holes formed when the notches are aligned with eh other when the form panels are installed.

Moreover, in a form panel for placing concrete of the present invention, preferably a hollow reinforcing panel section which is parallel to the side panel section is provided on an opposite surface of the concrete placing surface of the sheathing section. Such a form panel offers a further improvement in durability and pressure tightness.

BEST MODE FOR CARRYING OUT THE INVENTION

Embodiment 1

Figure 1:
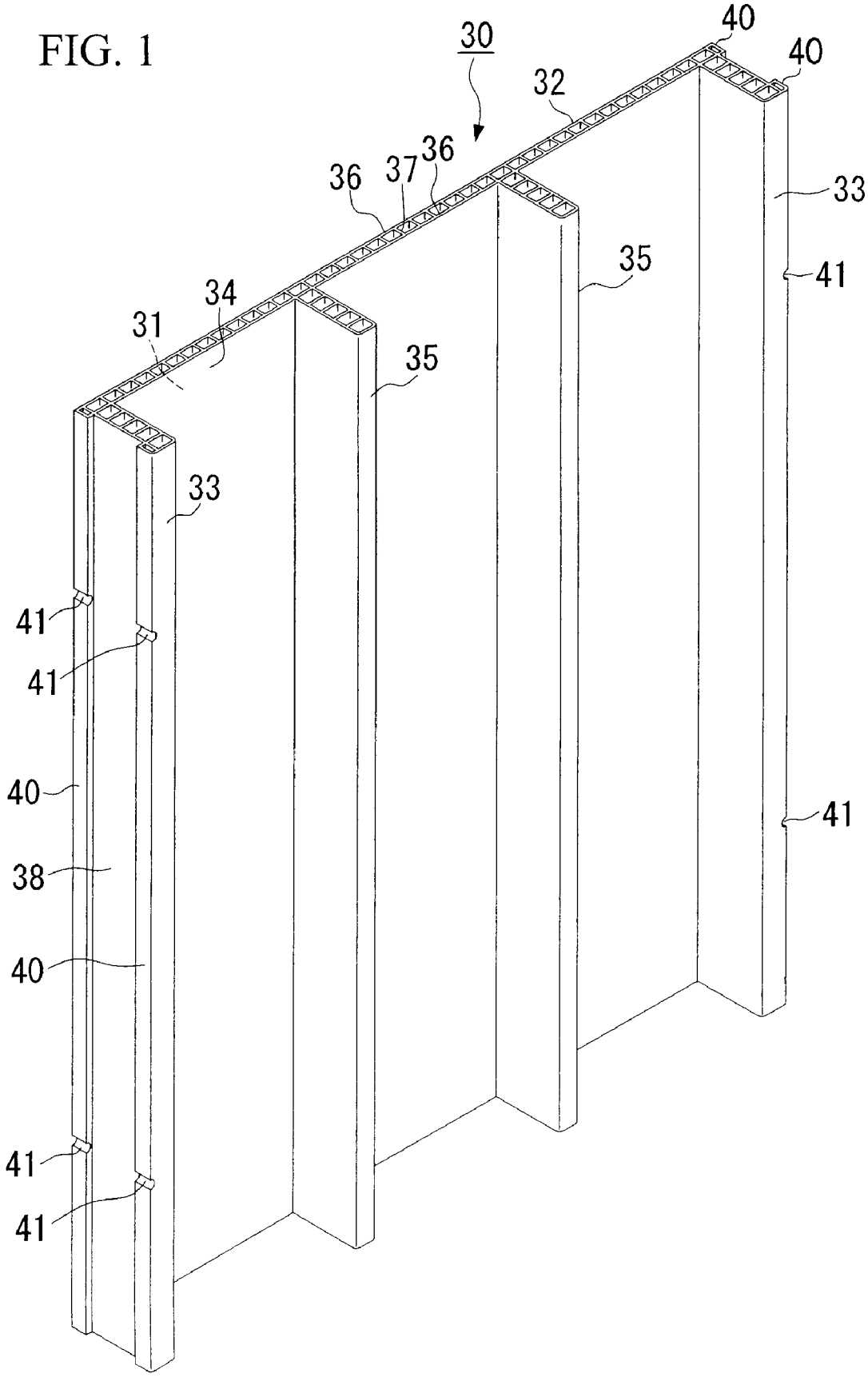
FIG. 1 is a perspective view showing an example of a form panel for placing concrete of the present invention.

FIG. 1 shows an example of a plastic form panel for placing concrete of the present invention. This form panel 30 comprises generally a hollow sheathing section 32, one side of which forms a concrete placing surface 31, hollow side panel sections 33 bent out at right angles from both side edges of the sheathing section 32 on the opposite side of the sheathing section 32 to the concrete placing surface 31, two hollow projecting sections 40 extending in the vertical direction, provided on both side edges of an outside surface 38 of the side panel sections 33, and two hollow reinforcing panel sections 35 provided on the rear surface 34 of the sheathing section 32 which are parallel to the side panel sections 33.

Here, one of the sides of the projecting section 40 which is nearest the concrete placing surface 31 is coplanar with the concrete placing surface 31 of the sheathing section 32, and in the two projecting sections 40, notches 41 orthogonal to the longitudinal direction of the projecting sections 40 are formed in the same positions in the upperportion and the lower portion of the projecting sections 40.

Furthermore, the sheathing section 32, the side panel sections 33 and the reinforcing panel sections 35 are formed from hollow panels in which two panels 36 and a plurality of long reinforcing ribs 37 connecting these panels, are formed as an integrated unit.

This form panel 30 is manufactured by integrally molding the sheathing section 32, the side panel sections 33, the projecting sections 40 a the reinforcing panel sections 35 by performing extrusion molding or the like of a plastic material.

Examples of suitable plastic materials are polypropylene, polycarbonate, polyvinyl chloride, polyethylene, ABS resin, nylon, polyethylene terephthalate (PET) and the like. Of these, polypropylene preferred as it offers excellent mechanical strength, concrete releasing properties, and alkaline resistance (concrete resistance).

There are no specific limitations on the dimensions, such as the thickness, width and height, of the sheathing section 32, the side panel sections 33 and the reinforcing panel sections 35, and these can have approximately the same dimensions as conventional plywood form panels, for example.

Furthermore, there are no specific limitations on the thickness of the two panels 36 and the reinforcing ribs 37 which constitute the sheathing section 32, the side panel sections 33 and the reinforcing panel sections 35,but taking the need for mechanical strength and reduced weight into consideration, a value of 1 to 3 mm, for example, is suitable.

The height of the projecting section 40 s set to an appropriate value according to the outside diameter of the separator which is inserted through the insertion holes formed when the notches 41 align with each other when a projecting section 40 is aligned with the projecting section 40 of another form panel 30 which is installed adjacent to the form panel 30. For example, if the outside diameter of the separator is a standard 8 mm, the height of the projecting section 40 is et to 5 mm, and the depth of the notches 41 is set to 4 mm.

Furthermore, the width of the projecting section 40 should be narrower than the width of the side panel section 33, but otherwise there are no specific restrictions.

Figure 2:
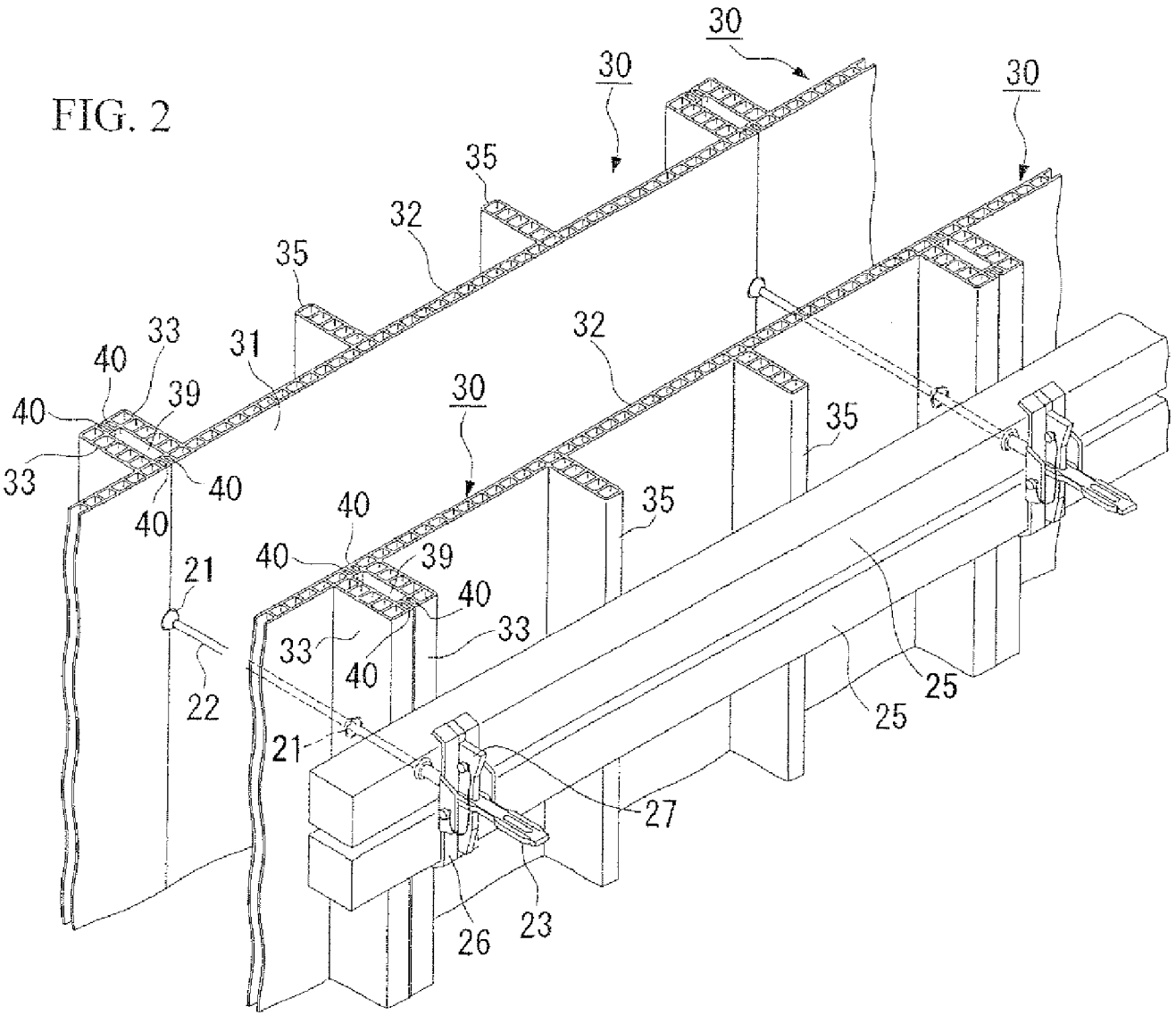
FIG. 2 is a perspective view showing an example of an installation configuration of the form panel for placing concrete shown in FIG. 1.
Figure 3:
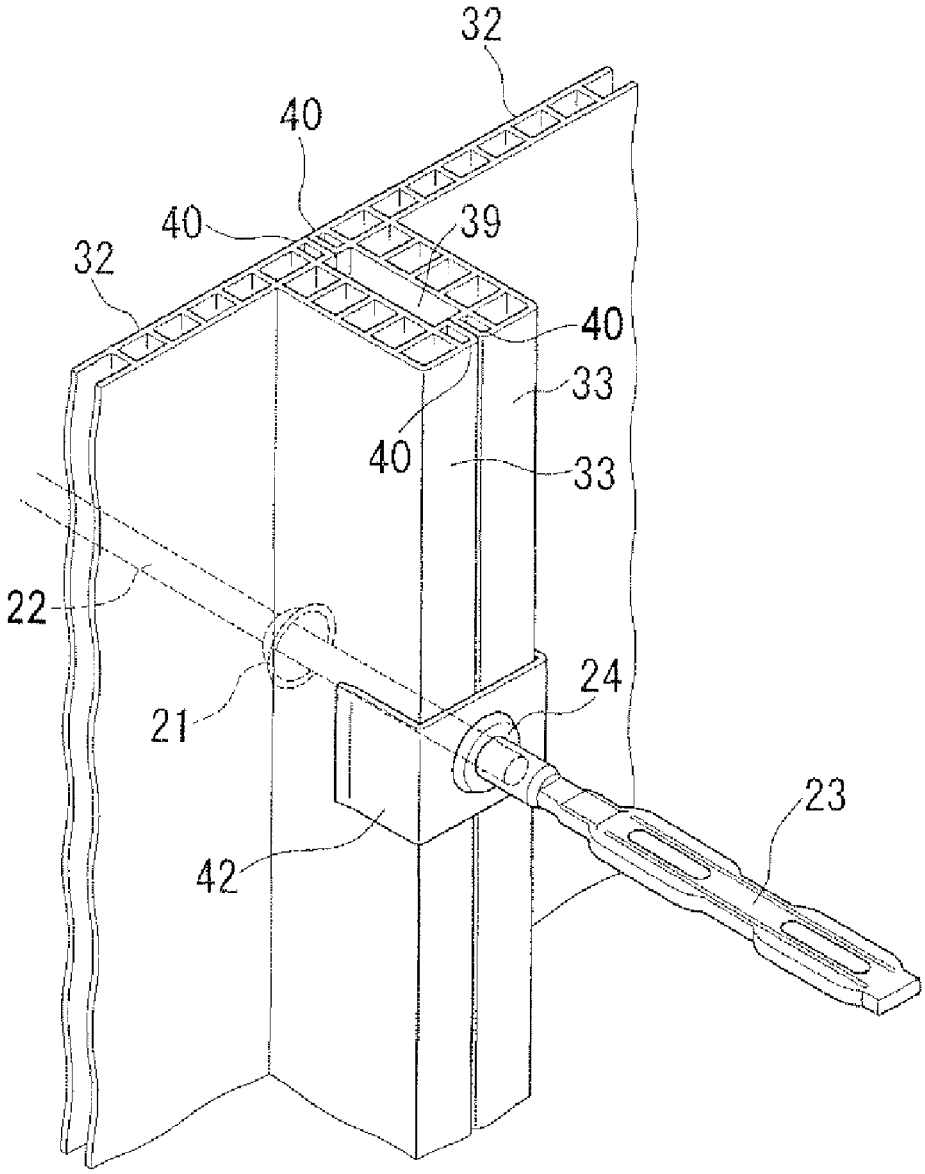
FIG. 3 is a perspective view of main elements showing an example of a contacting portion between form panels for placing concrete.

Next, the erection (installation) of the form panel for placing concrete of the present invention is described with reference to FIG. 2 and FIG. 3.

First, a plurality of the form panels 30 are aligned in a row so that the projecting sections 40 provided on the outside surfaces 38 of the side panel sections 33 are in contact with each other. A round rod-like separator 22 on which a P-Cone 21 is provided is inserted through the insertion hole formed when the notches 41 in the projecting section 40 on a form panel 30 align with the notches 41 in the projecting section 40 on n adjacent form panel 30. A clip fitting 42 bent into a U shaped cross-section is fitted over the side edges of the adjacent side panel sections 33, in such a manner that the end of the separator 22 protrudes from a hole in the center of the clip fitting 42, so as to sandwich the side panel sections 33, thereby connecting the form panels 30. Next, a clamp 23 is screwed onto the end of the separator 22, and the form panels 30 are held so that the width direction of the side panel sections 33 is sandwiched between the P-Cone 21 of the separator 22 and the template 24 at the base end of the clamp 23.

In the same manner, another row of a plurality of form panels 30 is arranged so that the concrete placing surfaces 31 oppose each other, and the separators 22 are inserted into the insertion holes. A clip fitting 42 is fitted over the side edges of the adjacent side panel sections 33, in such a manner that the end of the separator 22 protrudes from a hole in the center of the clip fitting 42, so as to sandwich the side panel sections 33, thereby connecting the form panels 30. Next, a clamp 23 is screwed onto the end of the separator 22 protruding from the insertion hole, and the form panels 30 are held so that the width direction of the side panel sections 33 is sandwiched between the P-Cone 21 of the separator 22 and the template 24 at the base end of the clamp 23.

In addition, a pair of walers 25 made of square pipe steel are provided above and below the clamps 23, and are secured by a clip plate 26 and a wedge 27 which fastens the clip plate 26 in such a state that the walers 25 contact the sides of the side panel sections 33 and the reinforcing panel sections 35. These walers 25 are provided to ensure that the form panel 30 does not expand outward due to the pressure of the concrete when the concrete is placed.

Because the form panel 30 described above is a plastic form panel for placing concrete, it has high durability, and can be recycled as plastic material after its useful life has been exceeded. Furthermore, because the form panel 30 is made of plastic, it has good concrete-releasing characteristics, making the use of concrete release agents unnecessary.

Moreover, because the form panel 30 is made of plastic, and comprises the sheathing section 32, one side of which forms the concrete placing surface 31, and the hollow side panel sections 33 bent out at right angles from both side edges of the sheathing section 32 on the opposite side of the sheathing section 32 to the concrete placing surface 31, it is not necessary to perform nailing to secure the battens, which results in good workability, and no reduction in durability as a result of the nailing process. Such a form panel 30 can be reused many more times than a conventional plywood form panel.

Furthermore, in such a form panel 30, the two projecting sections 40 which extend in the vertical direction are provided on the outside surface 38 of the side panel section 33, and the notches 41 which are orthogonal to the longitudinal direction of the projecting sections 40 are formed in the same positions in both of the projecting sections. Consequently, when erecting the form panel 30, the separator 22 can be passed through the insertion hole formed when the notches 41 in one form panel 30 align with the notches 41 in n adjacent form panel 30.

Moreover, in such a form panel 30, because the clamping pressure produced by the P-Cone 21 on the separator 22 and the template 24 at the base end of the clamp 23 is borne across the width direction of the side panel section 33, the form panel 30 exhibits sufficient strength to withstand this pressure. Consequently, even when using formwork fittings in which pressure tends to concentrate on a single point, such as at the P-Cones 21 and clamps 23 used with conventional plywood form panels, the form panel 30 is not damaged.

Furthermore, in this form panel 30, because the contacting area of the projecting sections 40, which represents the portion of adjacent form panels 30 which are in contact, is less than in conventional form panels in which the entire surfaces of the side panel sections are in contact, it is less likely that gap will for in the contacting portion of the projecting sections 40, and therefore less likely that concrete will leak out.

Moreover, compared to conventional form panels in which it is necessary to provide insertion grooves across the entire surface of the side panel sections, in this form panel 30, the length of the notches 41 need only be short, and so forming the notches 41 is comparatively easy.

Furthermore, in this form panel 30, since two projecting sections 40 which extend in the vertical direction are provided on the outside surfaces 38 of the side panel sections 33, when the form panels 30 are erected, a space 39 is formed between adjacent form panels 30 which is enclosed by the side panel sections 33 and the projecting sections 40. This space 39 can serve the function of collecting any concrete which leaks out from the contacting portion between the projecting sections 40 which adjoin on the concrete placing surface 31 side of the form panel 30, and consequently concrete does not leak outside the form panel 30.

Moreover, in this form panel 30, because one of the side surfaces of one of the two projecting sections 40 is coplanar with the concrete placing surface 31 of the sheathing section 32, the surface of the concrete placed after installing the form panel does not present irregularities where the form panels 30 are joined to each other, and the concrete surface can be kept flat.

Furthermore, because reinforcing panel sections 35 which are parallel to the side panel sections 33 are provided on the rear surface 34 of the concrete placing surface 31 of the sheathing section 32, the durability and pressure tightness of the form panel 30 are further improved.

Moreover, the sheathing section 32, the side panel sections 33 and the reinforcing panel sections 35 are hollow panels formed by integrating two panels 36 and a plurality of reinforcing ribs 37 connecting these panels. Consequently the form panel 30 is lightweight, and yet has sufficient mechanical strength.

Figure 4:
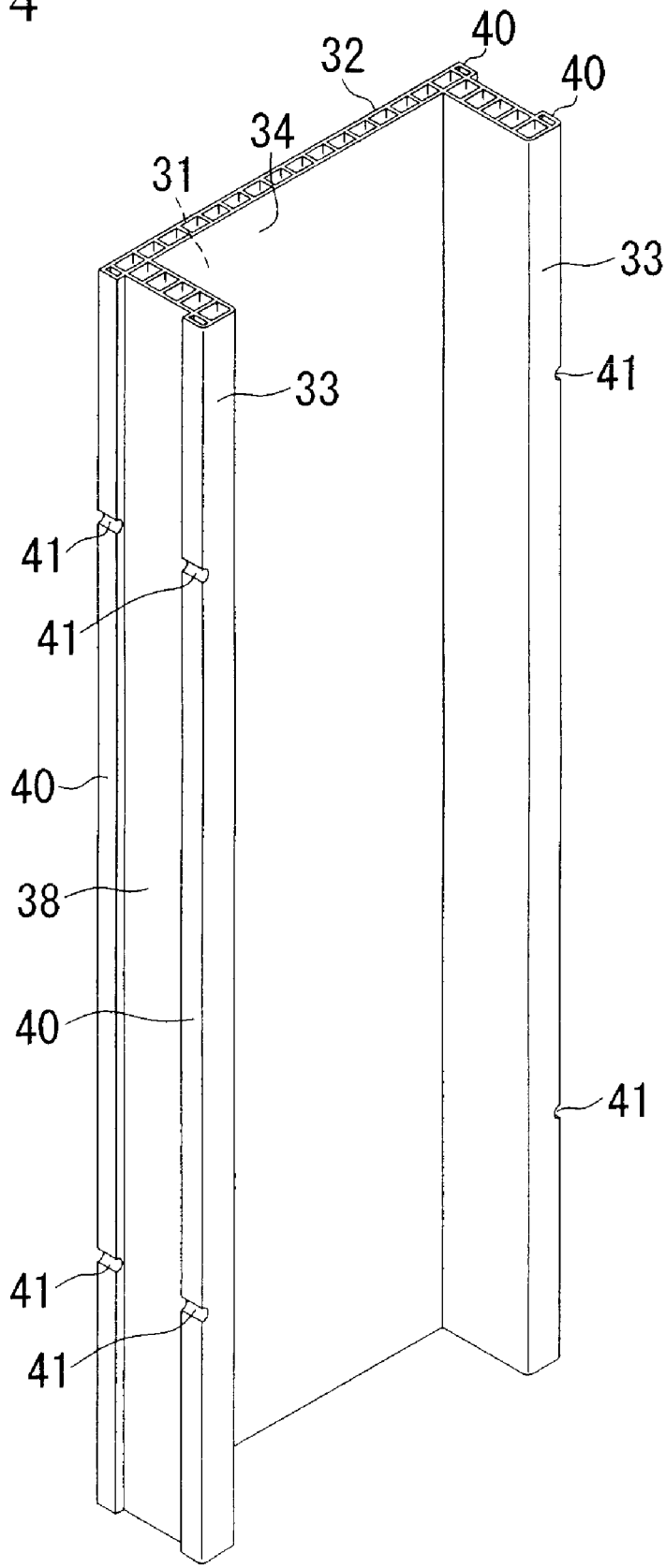
FIG. 4 is a perspective view showing another example of a form panel for placing concrete of the present invention.

The plastic form panel for placing concrete of the present invention is not limited to the construction shown in FIG. 1, and when the sheathing section 32 is narrow, it is possible to omit the reinforcing panel sections, as shown in FIG. 4, for example.

Furthermore, provided projecting sections are provided on the outside surface of at least one of the side panel sections, projecting sections need not necessarily be provided on the outside surfaces of both of the side panel sections.

Moreover, the positions of the projecting sections are not restricted to the positions shown in the figures, and provided that one of the sides of one of the two vertical projecting sections is coplanar with the concrete placing surface of the sheathing section, the other projecting section need not be provided at the side edge of the side panel section as shown in the figures.

Figure 5:
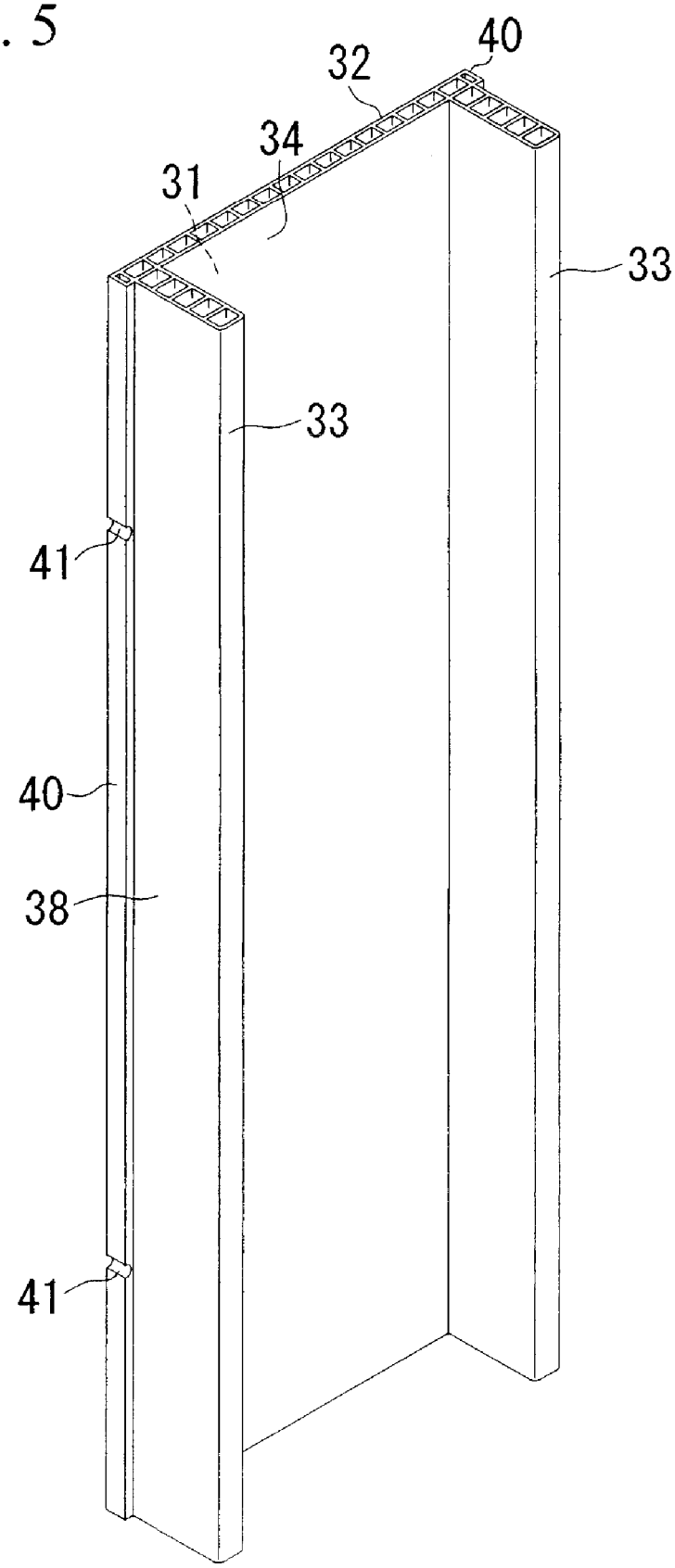
FIG. 5 is a perspective view showing yet another example of a form panel for placing concrete of the present invention.

Furthermore, the number of projecting sections is not restricted to two as shown in the figures, and there may be only one as shown in FIG. 5, or even three or more. However, as described above, if there are at least two projecting sections, then concrete which has leaked out can collect in the space enclosed by the side panel sections and the projecting sections, and consequently it is preferable that there are a plurality of projecting sections.

Moreover, it is not always necessary for notches 41 to be provided in the projecting sections 40 prior to installation. The notches 41 may be formed on the site where the concrete is to be placed, after the location at which the separator 22 is to be inserted has been determined on sit. Furthermore, insertion holes for the separator may also be formed in the sheathing section 32.

Moreover, a plastic form panel for placing concrete of the present invention is not limited to a construction in which the sheathing section 32, the side panel sections 33, the projecting sections 40 and the reinforcing panel sections 35 are formed as an integrated unit by extrusion molding of a plastic material, as ascribed above. For example, a process may be used in which a form panel main body is manufactured by forming the sheathing section 32, the side panel sections 33 and the reinforcing panel sections 35 as an integrated unit, and long rod or tube shaped members are then attached to the outside surface 38 of these side panel sections 33, either by fusing the members by heating, or by bonding the members using an adhesive, thereby forming the projecting section 40.

Furthermore, the materials used to make the projecting sections may be the same materials as for the form panel main body, or different materials. If the material used to make the projecting sections is different from the materials used to make the form panel main body, then a soft resin or a semi hard resin is the most suitable material for making the projecting sections. There are considerable advantages in using a soft resin or a semi hard resin to make the projecting sections, in that (I) firming the notches is easier, (II) iien the projecting sections are aligned with the projecting sections on another form panel, the projecting sections deform due to the elasticity of the resin, eliminating gaps at the contacting portions between the adjacent projecting sections, and (III)iiien a flat separator is used as the separator, the width of the separator can be absorbed by the elasticity of the resin, meaning the is no need to form the notches. When a soft resin or a semi hard resin is used as the material for the projecting sections, then in terms of mechanical strength, it is preferable that the projecting sections are not hollow. Furthermore, the projecting sections made from a soft resin or a semi hard resin may be formed as an integrated unit with the form panel main body, or may be fused or bonded to the form panel main body.

Examples of the above soft resins or semi hard resins include polymer materials such as thermoplastic elastomers, synthetic rubber, and natural rubber and the like. Here, thermoplastic elastomers refer to polymer materials which display rubber-like elasticity at room temperature but are plasticized at high temperatures and become moldable. Examples of these thermoplastic elastomers include polystyrene based thermoplastic elastomers (SDC), polyolefin based thermoplastic elastomers (TPO), polyvinyl chloride based thermoplastic elastomers (PVCT), polyurethane based thermoplastic elastomers (TPU), polyester based thermoplastic elastomers (TPEE), polyamide based thermoplastic elastomers (TPEA), 1, 2-polybutadiene based thermoplastic elastomers (TPVB), transpolyisoprene based thermoplastic elastomers (TPI), fluororubber based thermoplastic elastomers, chlorinated polyethylene based thermoplastic elastomers (T-CM), and dynamically crosslinked thermoplastic elastomers (DVTPE).

Furthermore, if the sheathing section is transparent or semitransparent, then light can pass through the form panel, allowing external light (sunlight) to enter a concrete placing site which is enclosed by form panels, eliminating the need for lighting.

Moreover, the separators used when erecting the form panels 30 are not limited to the round rod-like separators shown in the figures, and any known type of separator, such as flat separators, can be used.

Furthermore, the installation positions of the clip fittings 42 used when erecting the form panels 30 are not limited to the positions at both ends of the separator 22 as shown in the figures, and the clip fittings 42 can be installed in any position provided that the side edges of the side panel section 33 can be sandwiched there between.

Figure 6:
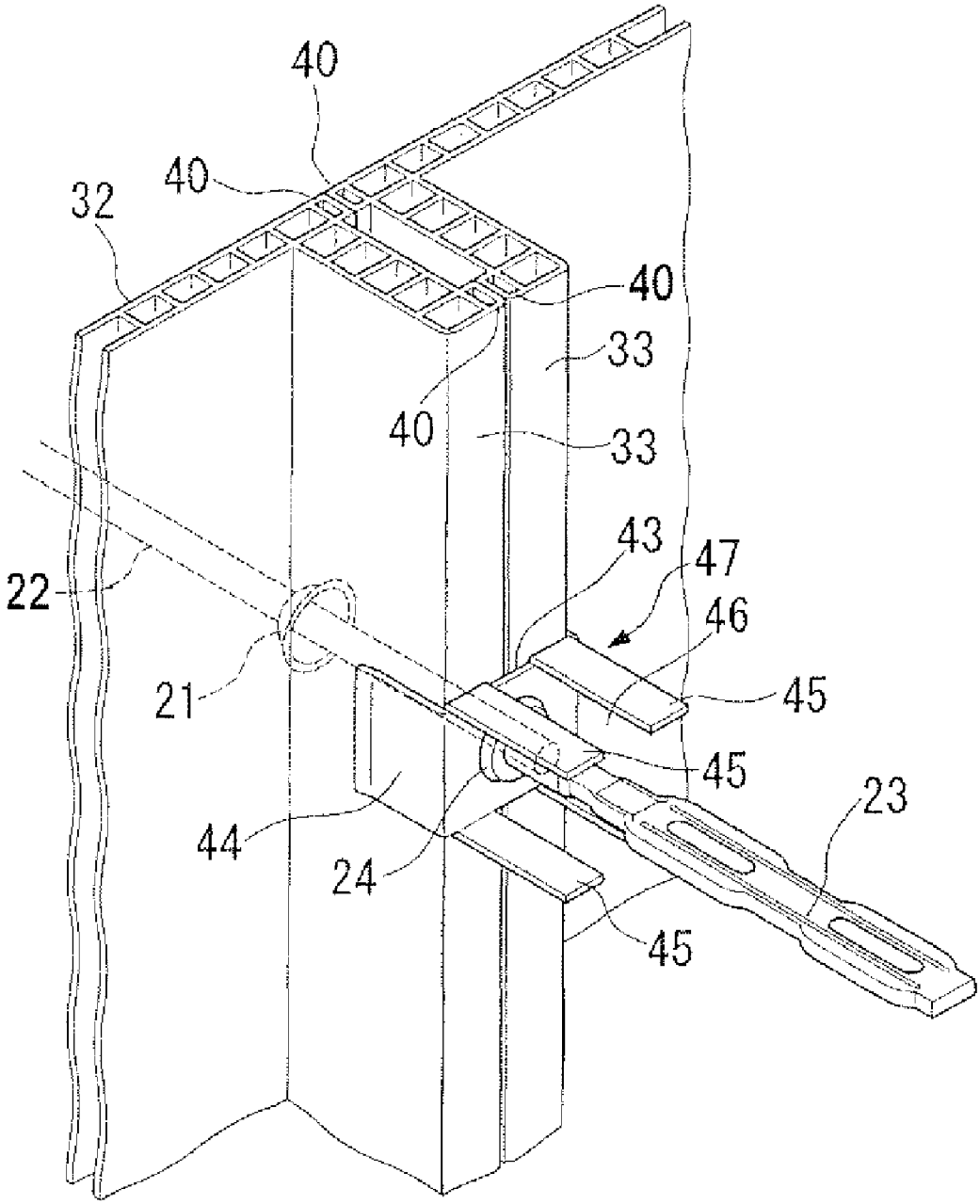
FIG. 6 is a perspective view of main elements showing another example of a contacting portion between form panels for placing concrete.

Moreover, the shape of the clip fitting is not limited to the shape of the clip fitting 42 shown in the figures. For example, FIG. 6 shows a different clip fitting which has eave sections 45 which are bent from the side edges of a central section of the fitting main body 43 in the opposite direction to the bend sections 44 of the fitting main body 43.

Because this clip fitting 47 has eave sections 45 which contact the walers 25 provided above and below the clip fitting 47, the walers 25 do not touch the template 24 of the clamp 23. Consequently, a gap equivalent to the thickness of the template 24 does not develop between the walers 25 and the side panel sections 33, and consequently the form panel 30 can be secured with high reliability by the walers 25, and does not expand outward due to the pressure of the concrete when the concrete is poured. Furthermore, because notched sections 46 are formed at the centers of the eave sections 45, it is easy to visually check the end of the separator 22 which protrudes from the hole in the center of the fitting main body 43. Consequently, when the clamp 23 is screwed onto the end of the separator 22, the eave sections 45 do not hinder this operation.

Embodiment 2

Figure 7:
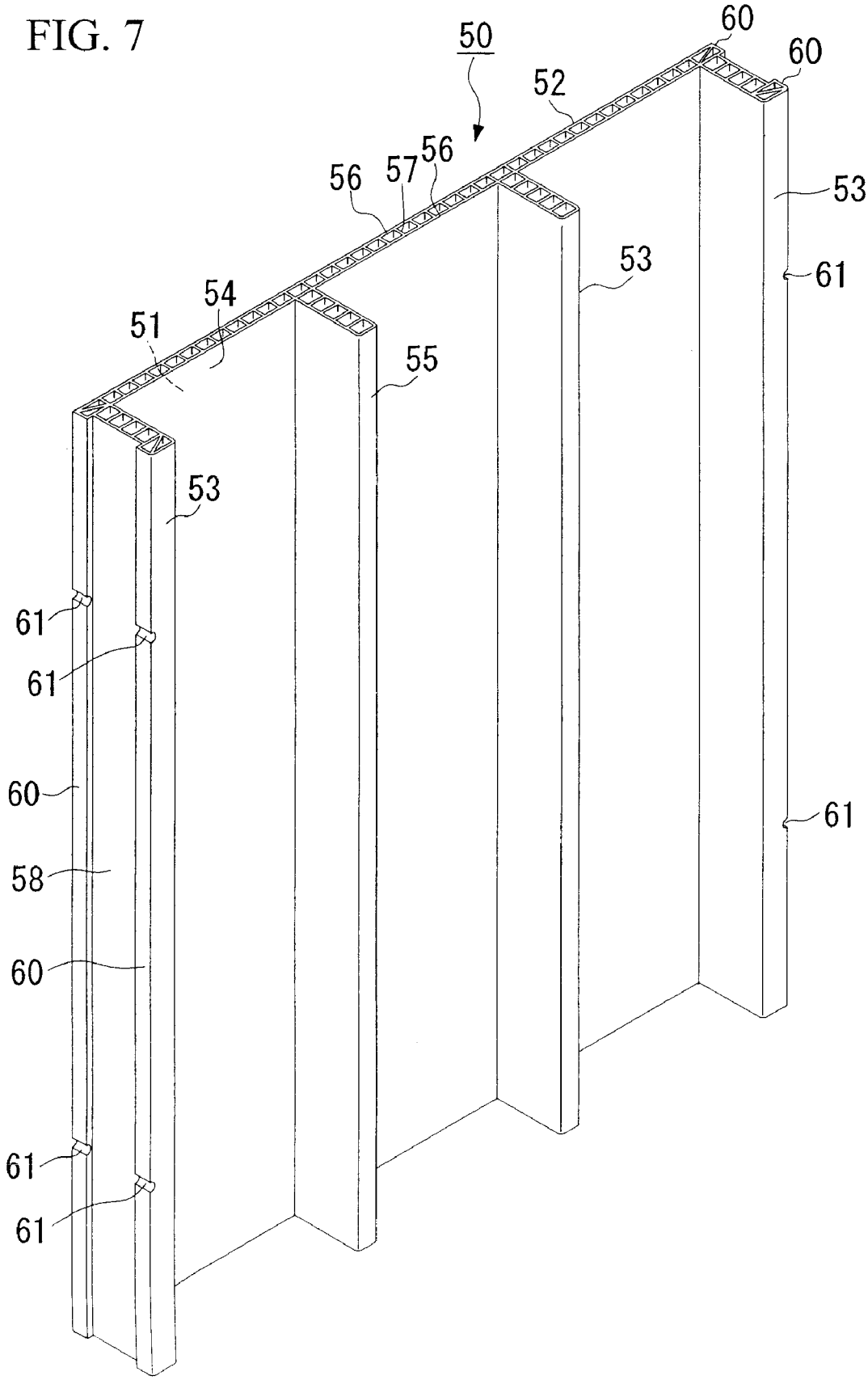
FIG. 7 is a perspective view showing yet another example of a form panel for placing concrete of the present invention.

FIG. 7 shows another example of a plastic form panel for placing concrete of the present invention. This form panel 50 comprises generally a hollow sheathing section 52, one side of which forms a concrete placing surface 51, hollow side panel sections 53 bent out at right angles from both side edges of the sheathing section 52 on the opposite side of the sheathing section 52 to the concrete placing surface 51, two hollow projecting sections 60 extending in the vertical direction, provided on both side edges of an outside surface 58 of the side panel sections 53, and two hollow reinforcing panel sections 55 provided on a rear surface 54 of the sheathing section 52 which are parallel to the side panel sections 53. Here, the sheathing section 52, the side panel sections 53 and the reinforcing panel sections 55 are formed from hollow panels in which two panels 56 and a plurality of long reinforcing ribs 57 connecting these panels, are formed as an integrated unit.

Furthermore, one of the sides of the projecting section 60 which is nearest the concrete placing surface 51 is coplanar with the concrete placing surface 51 of the sheathing section 52. Moreover, in the two projecting sections 60, notches 61 orthogonal to the longitudinal direction of the projecting sections 60 are formed in the same positions in the upper and the lower portions of the projecting sections 60.

Figure 8:
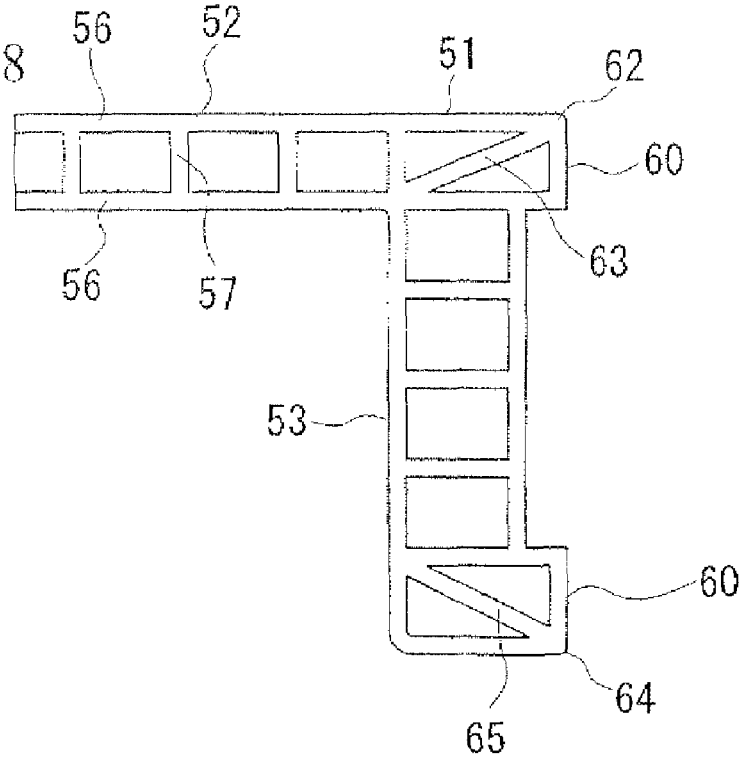
FIG. 8 is a top view showing a side panel section of the form panel for placing concrete shown in FIG. 7.

Furthermore, as shown in FIG. 8, a long diagonal rib 63, which is diagonal relative to the concrete placing surface 51, is formed in the projecting section 60 nearest the concrete placing surface 51, and contacts the inside of a corner section 62 on the concrete placing surface 51 side. In the same manner, a long diagonal rib 65 which contacts the inside of a corner section 64 is formed in the other projecting section 60.

Figure 9:
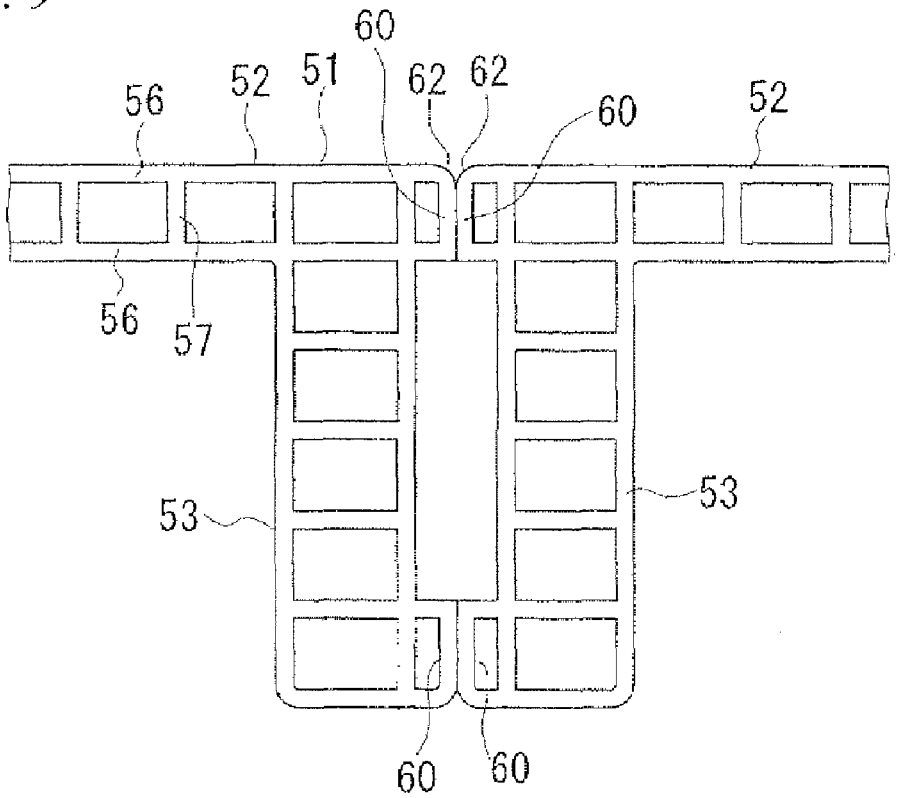
FIG. 9 is a top view showing a side panel section in a case where diagonal ribs are not provided in projecting sections.

The diagonal rib 63 maintains the corner section 62 of the projecting section 60 nearest the concrete placing surface 51 as a sharp angle. In other words, when the form panel 50 is extruded from a mold by means of extrusion molding, for example, and then cooled, if the diagonal rib 63 which contacts the inside of the corner section 62 is not present, then the corner section 62 of the projecting section 60 tends to become rounded as shown in FIG. 9. If the corner section 62 becomes rounded, then when the form panels 50 are installed, the concrete placing surface 51 is not flat at the points where the form panels50 are joined to each other, and protrusions appear in the placed concrete surface at the joints between the form panels 50, as shown in FIG. 9.

Moreover, the diagonal ribs 63 and 65 prevent deformation of the projecting section 60. In other words, when the form panels 50 are erected, only the projecting sections 60 of the adjacent form panels 50 are in contact with each other, and consequently the force applied during the erection process tends to be concentrated on the projecting sections 60. Furthermore, the projecting sections 60 are clamped from the side by the P-Cone 21 and the template 24 of the clamp 23, and consequently it is preferable that ribs which reinforce the projecting sections 60 are provided.

This form panel 50 is manufactured by forming the sheathing section 52, the side panel sections 53, the projecting sections 60 and the reinforcing panel sections 55 as an integrated unit, by performing extrusion molding or the like of a plastic material, for example. Examples of plastic materials are the same as those described for the form panel 30 of the first embodiment.

There are no specific limitations on the dimensions, such as the thickness, width and height, of the sheathing section 52, the side panel sections 53 and the reinforcing panel sections 55, and these can have approximately the same dimensions as conventional plywood form panels, for example.

Furthermore, there are no specific limitations on the thickness of the two panels 56 and the reinforcing ribs 57 which constitute the sheathing section 52, the side panel sections 53 and the reinforcing panel sections 55, or on the thickness of the diagonal ribs 63 and 65, but taking the need for mechanical strength and reduced weight into consideration, a value of 1 to 3 mm, for example, is suitable.

The height of the projecting sections 60 is approximately the same as that of the projecting sections 40 in the form panel 30 of the first embodiment. Furthermore, there are no specific limitations on the width of the projecting sections 60, provided that it is narrower than the width of the side panel sections 53.

Figure 10:
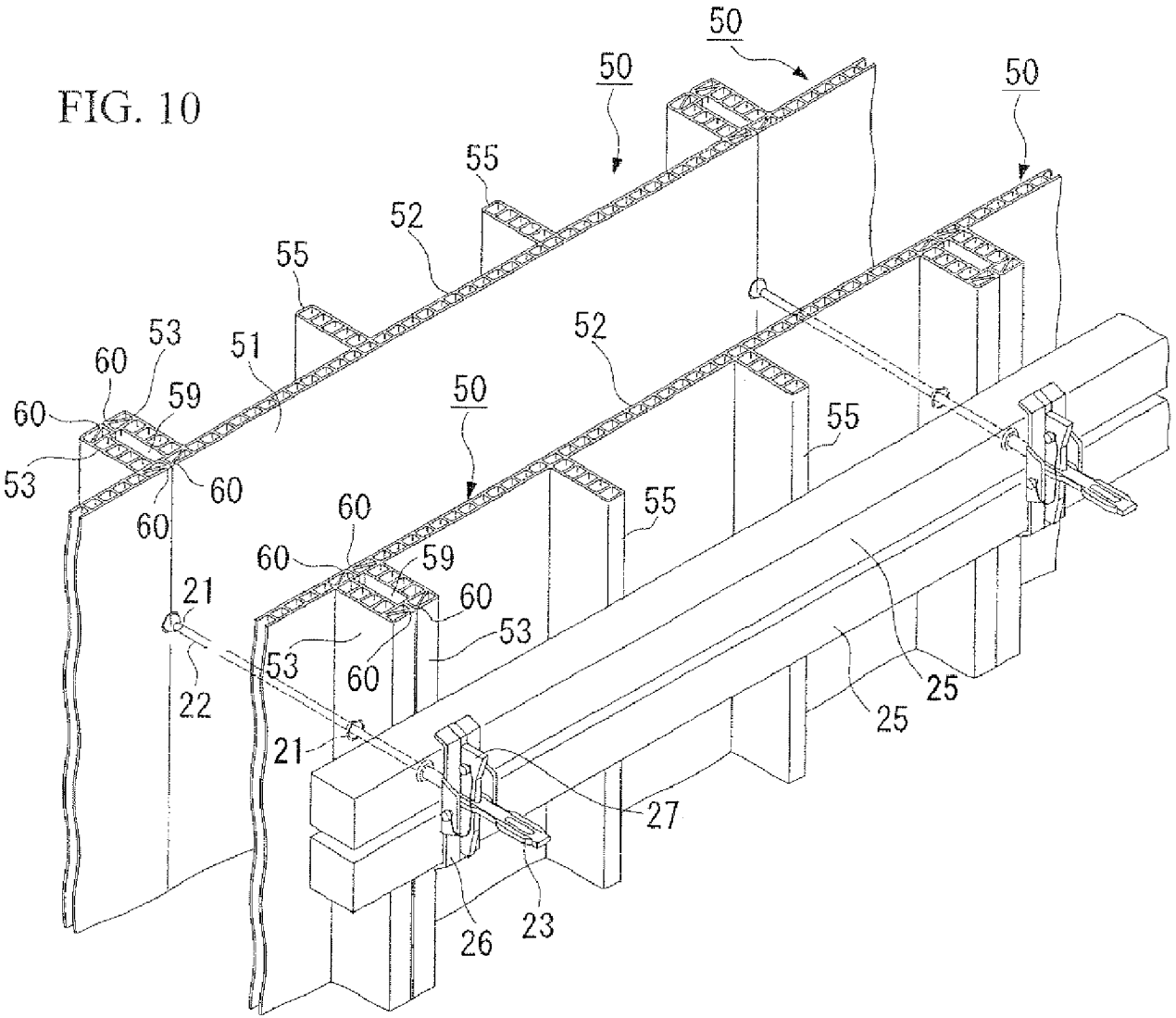
FIG. 10 is a perspective view showing an example of an installation configuration of the form panel for placing concrete shown in FIG. 7.

Next, the erection (installation) of this form panel for placing concrete of the present invention is described with reference to FIG. 10.

First, a plurality of the form panels 50 are aligned in a row so that the projecting sections 60 provided on the outside surfaces 58 of the side panel sections 53 are in contact with each other. A round rod-like separator 22 on which a P-Cone 21 is provided is inserted through the insertion hole formed when the notches 61 in the projecting section 60 on a form panel 50 align with the notches 61 in the projecting section 60 in an adjacent form panel 50. A clip fitting 42 bent into a U shaped cross-section is fitted over the side edges of the adjacent side panel sections 53, in such a manner that the end of the separator 22 protrudes from a hole in the center of the clip fitting 42, so as to sandwich the side panel sections 53, thereby connecting the form panels 50. Next, a clamp 23 is screwed onto the end of the separator 22, and the form panels 50 are held so that the width direction of the side panel sections 53 is sandwiched between the P-Cone 21 of the separator 22 and the template 24 at the base end of the clamp 23.

In the same manner, another row of a plurality of form panels 50 is arranged so that the concrete placing surfaces 51 oppose each other, and the separators 22 are inserted into the insertion holes. A clip fitting 42 is fitted over the side edges of the adjacent side panel sections 53, in such a manner that the end of the separator 22 protrudes from a hole in the center of the clip fitting 42, so as to sandwich the side panel sections 53, thereby connecting the form panels 50. Next, a clamp 23 is screwed onto the end of the separator 22 protruding from the insertion hole, and the form panels 50 are held so that the width direction of the side panel sections 53 is sandwiched between the P-Cone 21 of the separator 22 and the template 24 at the base end of the clamp 23.

In addition, a pair of walers 25 made of square pipe steel are provided above and below the clamps 23, and are secured by a clip plate 26 and a wedge 27 which fastens the clip plate 26 in such a state that the walers 25 contact the sides of the side panel sections 53 and the reinforcing panel sections 55. These walers 25 are provided to ensure that that the form panel 50 does not expand outward due to the pressure of the concrete when the concrete is placed.

Because the form panel 50 described above is a plastic form panel for placing concrete, it has high durability, and can be recycled as plastic material after its useful life has been exceeded. Furthermore, because the form panel 50 is made of plastic, it has good concrete-releasing characteristics, making the use of concrete release agents unnecessary.

Moreover, because the form panel 50 is made of plastic, and comprises the sheathing section 52, one side of which forms the concrete placing surface 51, and the hollow side panel sections 53 bent out at right angles from both side edges of the sheathing section 52 from the opposite side of the sheathing section 52 to the concrete placing surface 51, it is not necessary to perform nailing to secure the battens, which results in good workability, and no reduction in durability as a result of the nailing process. Such a form panel 50 can be reused many more times than a conventional plywood form panel.

Furthermore, in such a form panel 50, the two projecting sections 60 which extend in the vertical direction are provided on the outside surface 58 of the side panel section 53, and the notches 61 which are orthogonal to the longitudinal direction of the projecting sections 60 are formed in the same positions in both of the projecting sections. Consequently, when erecting the form panel 50, the separator 22 can be passed through the insertion hole formed when the notches 61 in one form panel 50 align with the notches 61 in an adjacent form panel 50.

Moreover, in such a form panel 50, because the clamping pressure produced by the P-Cone 21 of the separator 22 and the template 24 at the base end of the clamp 23 is borne across the width direction of the side panel section 53, the form panel 50 exhibits sufficient strength to withstand this pressure. Consequently, even when using formwork fittings in which pressure tends to concentrate on a single point, such as at the P-Cones 21 and clamps 23 used with conventional plywood form panels, the form panel 50 is not damaged.

Furthermore, in this form panel 50, because the diagonal rib 63 is provided in the projecting section 60 nearest the concrete placing surface 51, rounding of the corners of the projecting section 60 does not occur during the formation of the form panel 50, and the angle of the corner section 62 can be kept sharp. Consequently when the form panels 50 are installed, crevices (seams) do not appear where the form panels 50 are joined to each other, enabling the placed concrete surface to be kept flat. Furthermore, in this form panel 50, because the diagonal ribs 63 and 65 are provided in the projecting sections 60, even if force is concentrated on the projecting sections 60 when the projecting sections 60 are clamped by the P-Cone 21 and the template 24 of the clamp 23 during installation of the form panel 50, the projecting sections 60 do not undergo deformation.

Figure 11:
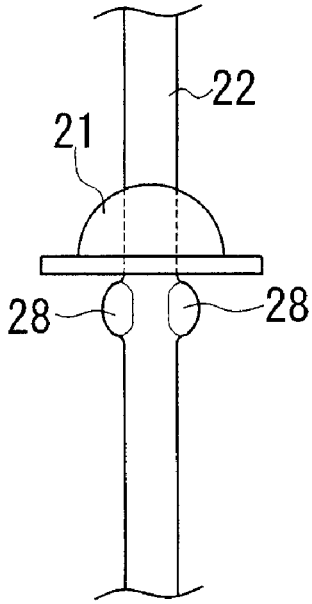
FIG. 11 is a top view showing an example of a separator.

Moreover, a stopper 28, which determines the position of the P-Cone 21, may be formed on the separator 22, as shown in FIG. 11. When a separator 22 on which such a stopper 28 is formed is inserted into the insertion hole formed when the notches 61 in adjacent projecting sections 60 align with each other, the stopper 28 contacts the diagonal rib 63 in the projecting section 60. Consequently, when the clamp 23 is screwed onto the end of the separator 22, the separator 22 can be prevented from turning in the insertion hole.

Furthermore, in this form panel 50, because the contacting area of the projecting sections 60, which represents the portion of adjacent form panels 50 which are in contact, is less than in conventional form panels in which the entire surfaces of the side panel sections are in contact, it is less likely for gaps to form in the contacting portion of the projecting sections 60, and therefore less likely that concrete will leak out.

Moreover, compared to conventional form panels in which it is necessary to provide insertion grooves across the entire surface of the side panel sections, in this form panel 50, the length of the notches 61 need only be short, and so forming the notches 61 is comparatively easy.

Furthermore, in this form panel 50, since two projecting sections 60 which extend in the vertical direction are provided on the outside surfaces 58 of the side panel sections 53, when the form panels 50 are erected, a space 59 is formed between adjacent form panels 50, which is enclosed by the side panel sections 53 and the projecting sections 60. This space 59 can serve the function of collecting any concrete which leaks out from the contacting portion between the projecting sections 60 which adjoin on the concrete placing surface 51 side of the form panel 50, and consequently concrete does not leak outside the form panel 50.

Furthermore, in this form panel 50, because one of the side surfaces of one of the two projecting sections 60 is coplanar with the concrete placing surface 51 of the sheathing section 52, the surface of the concrete placed after installing the form panel does not present irregularities where the form panels 50 are joined to each other, and the concrete surface can be kept flat.

Moreover, because reinforcing panel sections 55 which are parallel to the side panel sections 53 are provided on the rear surface 54 of the concrete placing surface 51 of the sheathing section 52, the durability and pressure tightness of the form panel 50 are further improved.

Furthermore, the sheathing section 52, the side panel sections 53 and the reinforcing panel sections 55 are hollow panels formed by integrating two panels 56 and a plurality of long reinforcing ribs 57 connecting these panels. Consequently the form panel 50 is lightweight, and yet has sufficient mechanical strength.

The plastic form panel for placing concrete of the present invention is not limited to the construction shown in FIG. 7, and when the sheathing section 52 is narrow, it is possible to omit the reinforcing panel sections, for example.

Moreover, a plastic form panel for placing concrete of the present invention is not limited to a construction in which the sheathing section 52, the side panel sections 53, the projecting sections 60 and the reinforcing panel sections 55 are formed as an integrated unit by extrusion molding of a plastic material as described above. For example, a process may be used in which a form panel main body is manufactured by forming the sheathing section 52, the side panel sections 53 and the reinforcing panel sections 55 as an integrated unit, and long rod or tube shaped members are then attached to the outside surface 58 of these side panel sections 53, either by fusing the members by heating, or by bonding the members using an adhesive, thereby forming the projecting section 60.

Furthermore, it is not always necessary for notches 61 to be provided in the projecting sections 60 prior to installation.

The notches 61 may be formed on the site where the concrete is to be placed, after the location at which the separator 22 is to be inserted has been determined on site. Moreover, insertion holes for the separator may be formed in the sheathing section 52.

Furthermore, provided projecting sections are provided on the outside surface of at least one of the side panel sections, projecting sections need not necessarily be provided on the outside surfaces of both of the side panel sections.

Moreover, the positions of the projecting sections are not restricted to the positions shown in the figures, and provided that one of the sides of one of the two vertical projecting sections is coplanar with the concrete placing surface of the sheathing section, the other projecting section need not be provided at the side edge of the side panel section as shown in the figures.

Furthermore, the number of projecting sections is not restricted to two as shown in the figures, and there may be only one, or even three or more. However, as described above, if there are at least two projecting sections, concrete which has leaked out can collect in the space enclosed by the side panel sections and the projecting sections, and consequently it is preferable that there are a plurality of projecting sections.

Moreover, the diagonal ribs in the projecting sections should be provided in at least the projecting section 60 nearest the concrete placing surface 51 so as to contact the inside of the corner section 62 nearest the concrete placing surface 51, and a diagonal rib need not necessarily be provided in the other projecting sections.

Furthermore, if the sheathing section is transparent or semitransparent, then light can pass through the form panel, allowing external light (sunlight) to enter a concrete placing site which is enclosed by form panels, eliminating the need for lighting.

Moreover, the separators used when erecting the form panels 50 are not limited to the round rod-like separators shown in the figures, and any known type of separator, such as flat separators, can be used.

Embodiment 3

Figure 12:
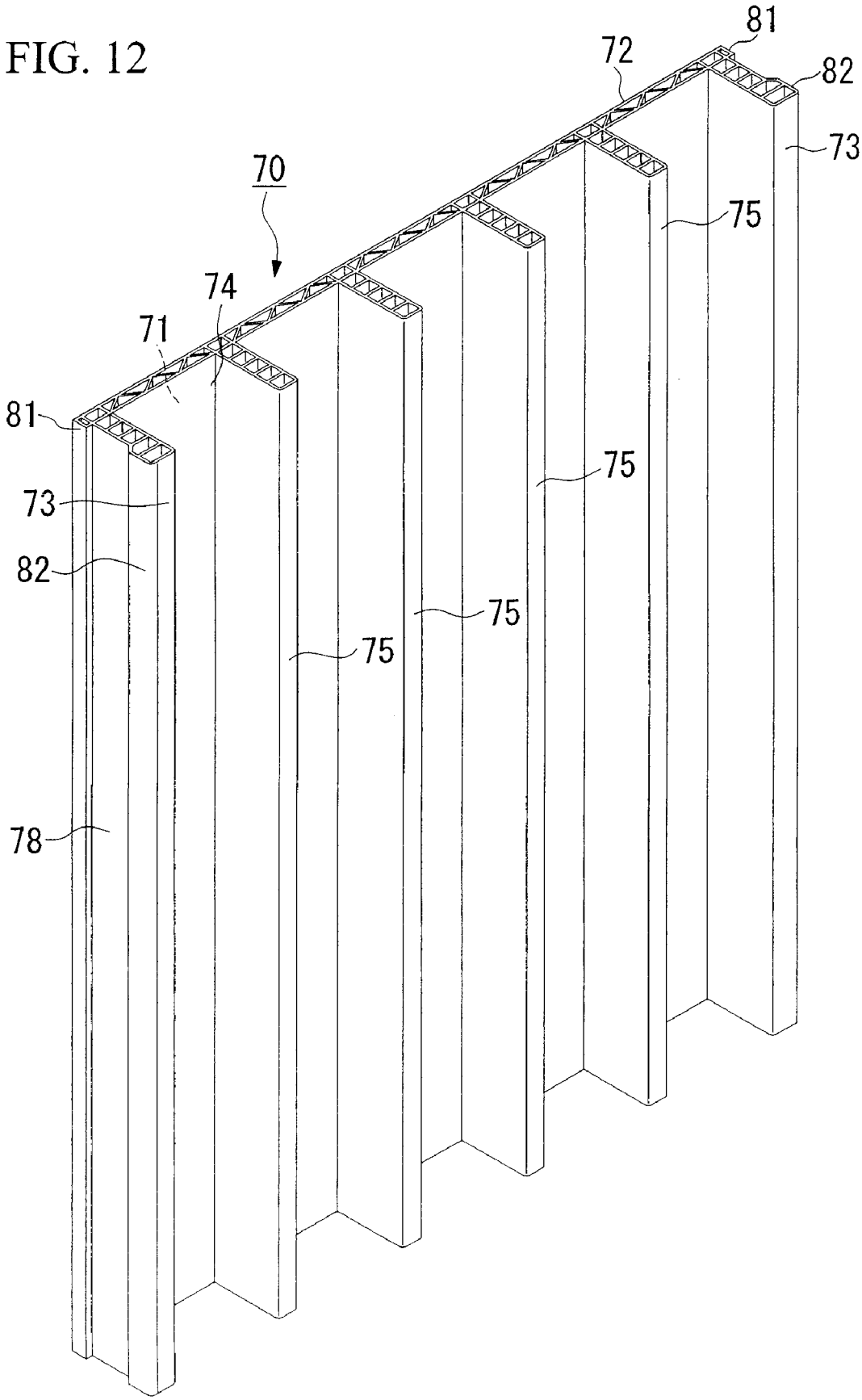
FIG. 12 is a perspective view showing yet another example of a form panel for placing concrete of the present invention.
Figure 13:
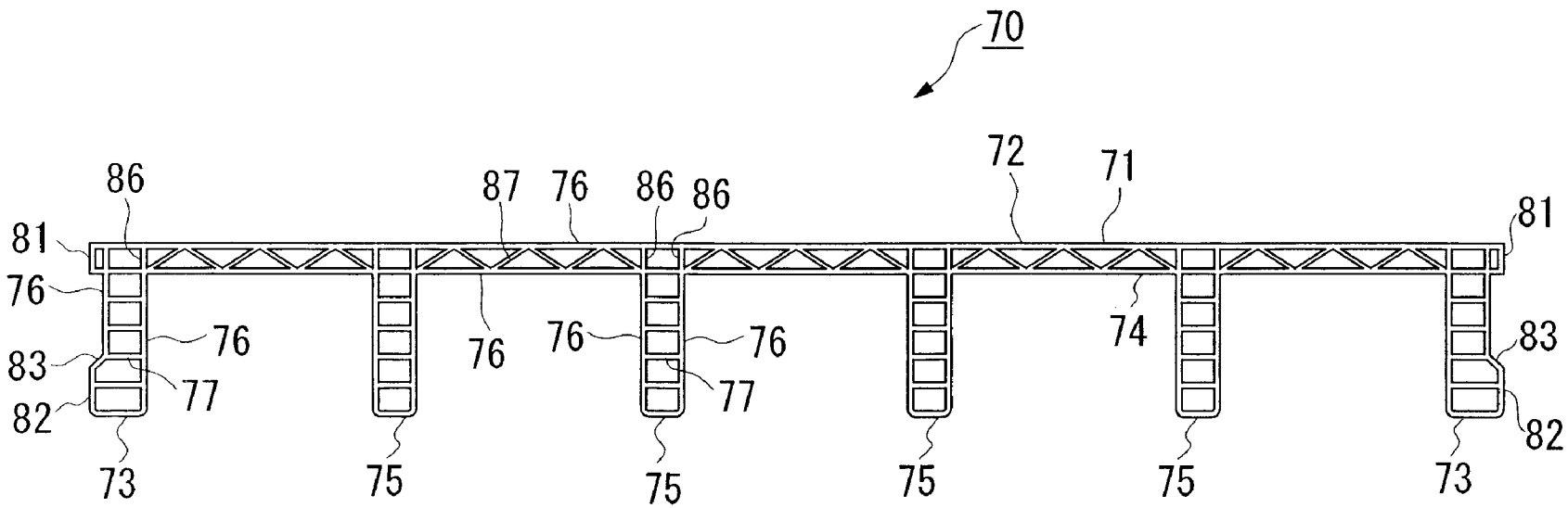
FIG. 13 is a top view of the form panel for placing concrete shown in FIG. 12.

FIG. 12 and FIG. 13 show another example of a plastic form panel for placing concrete of the present invention. This form panel 70 comprises generally a hollow sheathing section 72, one side of which forms a concrete placing surface 71, hollow side panel sections 73 bent out at right angles from both side edges of the sheathing section 72 on the opposite side of the sheathing section 72 to the concrete placing surface 71, two hollow projecting sections 81and 82 extending in the vertical direction, provided at the side edges of an outside surface 78 of the side panel sections 73, and four hollow reinforcing panel sections 75 which are parallel to the side panel sections 73.

Here, one of the sides of the projecting section 61 nearest the concrete placing surface 71 is coplanar with the concrete placing surface 71 of the sheathing section 72.

Furthermore, an inclined surface 83 is formed on the side surface of the projecting section 82 which faces the projecting section 81.

Figure 14:
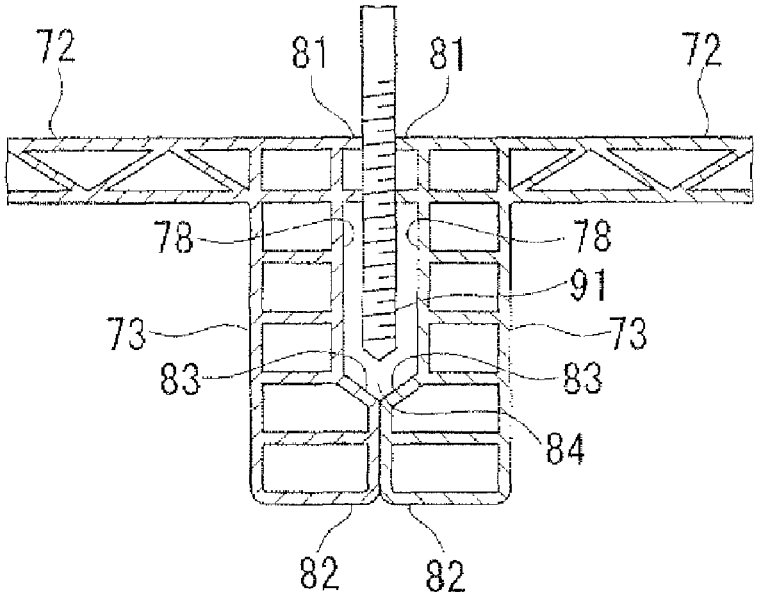
FIG. 14 is a cross-sectional view showing the provision of an insertion hole for inserting a separator in a contacting portion between form panels for placing concrete.

As shown in FIG. 14, when a plurality of form panels 70 are aligned in a row so that the projecting sections 81 and the projecting sections 82 provided on the outside surfaces 78 of adjacent side panel sections 73 contact each other, the inclined surfaces 83 on the projecting sections 82 face each other, thereby forming a V-shaped groove 84 when viewed in cross-section.

The groove 84 which is formed in this manner acts as a guiding groove for the tip of a drill 91, used when forming an insertion hole for inserting a separator in the contacting portion between the projecting sections 82, during the erection (installation) of the form panel 70, which is described below.

If the inclined surface 83 is not formed on the projecting section 82, then the guide groove for the tip of the drill is also not formed. Consequently when an attempt is made to form an insertion hole for inserting the separator in the contacting portion between the projecting sections 82 using the drill 91, the tip of the drill can deviate to the left or right of the contacting portion of the projecting sections 82, meaning the insertion hole for the separator is not formed perpendicularly relative to the sheathing section 72, and consequently fails to function effectively as an insertion hole.

Figure 15:
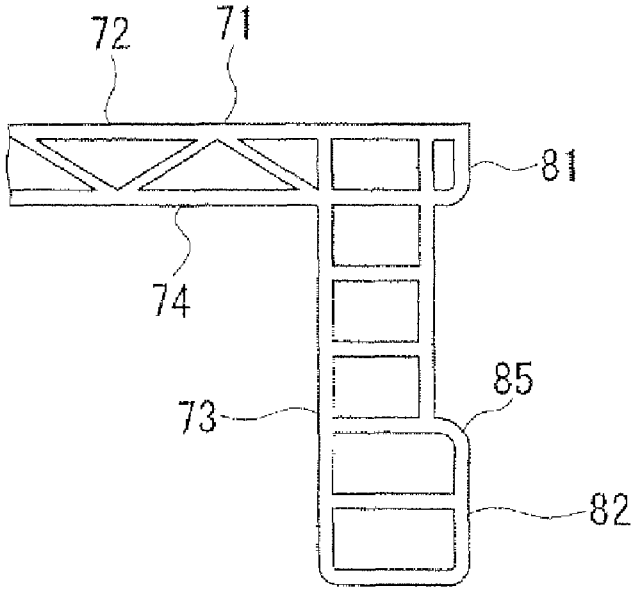
FIG. 15 is a top view showing another example of projecting sections in a form panel for placing concrete of the present invention.

The inclination of the side surface of the projecting section in the present invention also includes a curved surface 85 such as that shown in FIG. 15.

The side panel sections 73 and the reinforcing panel sections 75 are made of hollow panels formed by integrating two panels 76 and a plurality of long reinforcing ribs 77 connecting these panels.

The sheathing section 72 is a hollow panel, in which two parallel panels 76 and a plurality of vertical long reinforcing ribs connecting these panels are formed as an integrated unit. In the sections where the side panel sections 73 and the reinforcing panel sections 75 contact the sheathing section 72, the reinforcing ribs in the sheathing section 72 are right angled ribs 86 at right angles to the concrete placing surface 71 and are formed as a continuation of the sets of panels 76 which form the side panel sections 73 and the reinforcing panel sections 75. In the other sections, the reinforcing ribs of the sheathing section 72 are diagonal ribs 87 which are inclined relative to the concrete placing surface 71, and are formed in a continuous manner in the form of a zigzag.

This form panel 70 is manufactured by forming the sheathing section 72, the side panel sections 73, the projecting sections 81 and 82 and the reinforcing panel sections 75 as an integrated unit, by performing extrusion molding or the like of a plastic material, for example. Suitable plastic materials are the same as those described for the form panel 30 of the first embodiment.

There are no specific limitations on the dimensions, such as the thickness, width and height, of the sheathing section 72, the side panel sections 73 and the reinforcing panel sections 75, and these can have approximately the same dimensions as conventional plywood form panels, for example.

Furthermore, there are no specific limitations on the thickness of the two panels 76, the reinforcing ribs 77, the right angled ribs 86 and the diagonal ribs 87 which constitute the sheathing section 72, the side panel sections 73 and the reinforcing panel sections75, but taking the need for mechanical strength and reduced weight into consideration, a value of 1 to 3 mm, for example, is suitable.

The heights of the projecting sections 81 and 82 are approximately the same as the height of the projecting section 40 in the form panel 30 of the first embodiment. Furthermore, there are no specific limitations on the width of the projecting sections 81 and 82, provided that they are narrower than the width of the side panel sections 73.

Figure 16:
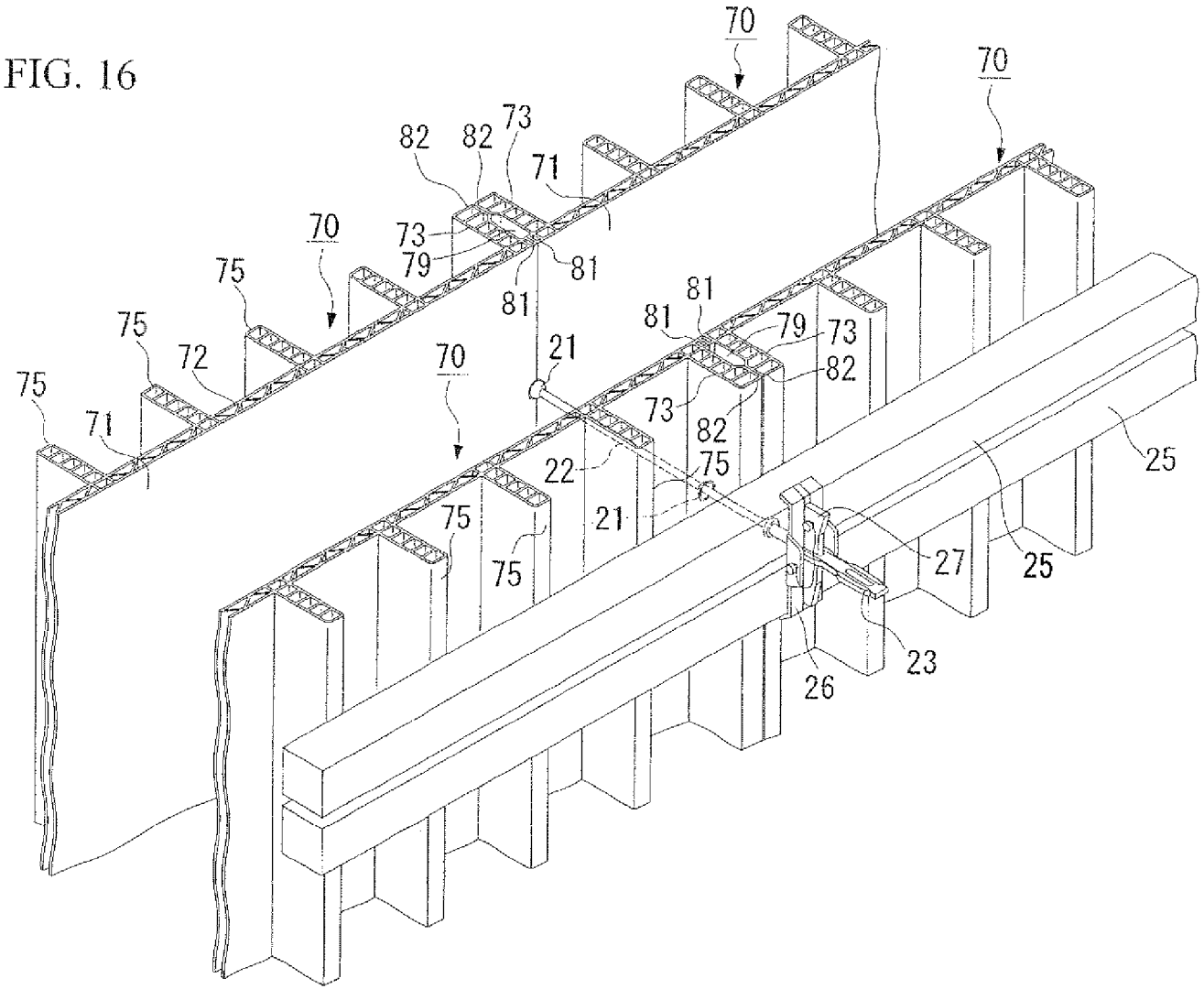
FIG. 16 is a perspective view showing another example of an installation configuration of the form panel for placing concrete shown in FIG. 12.
Figure 17:
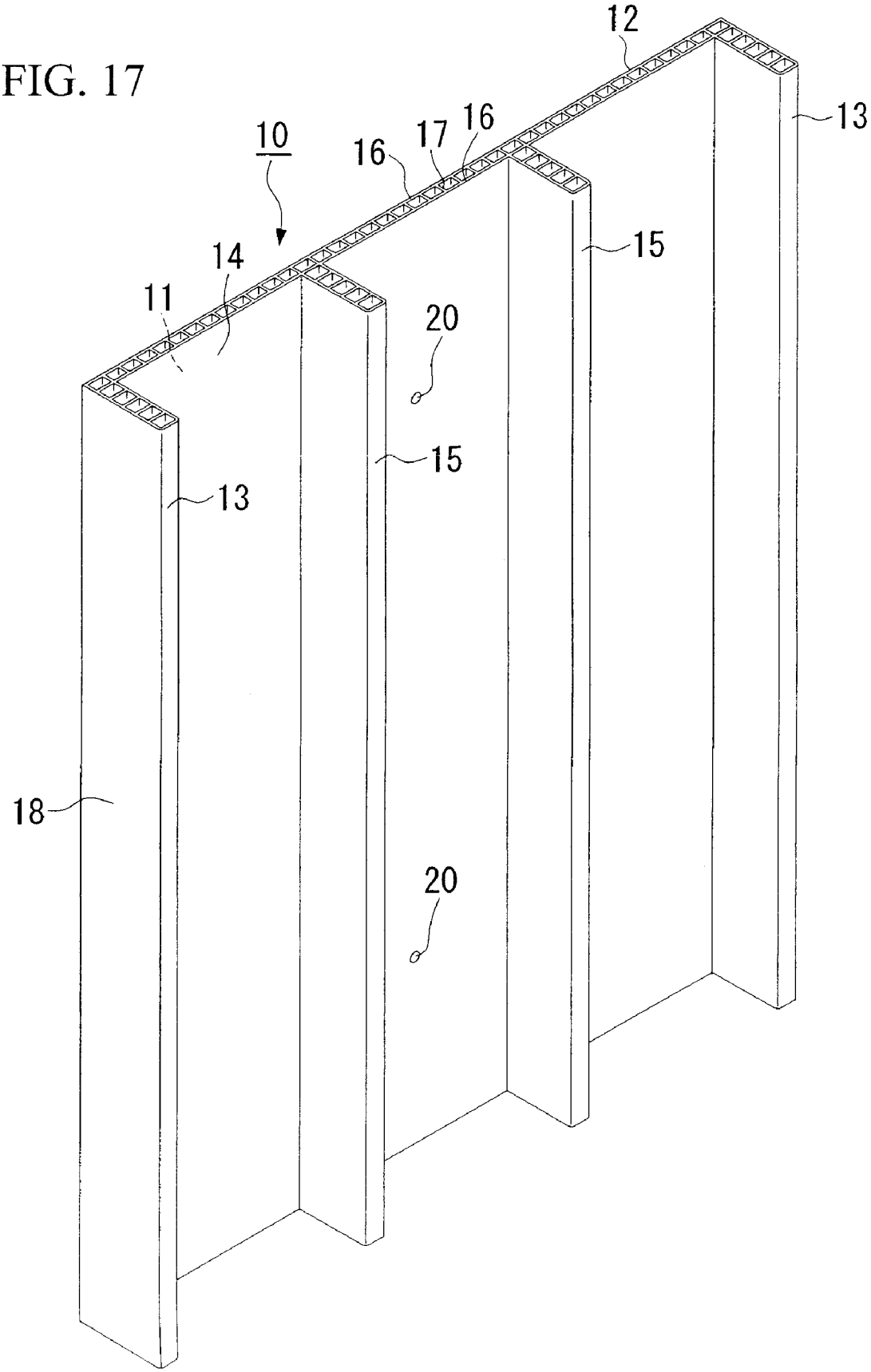
FIG. 17 is a perspective view showing an example of a conventional form panel for placing concrete.
Figure 18:
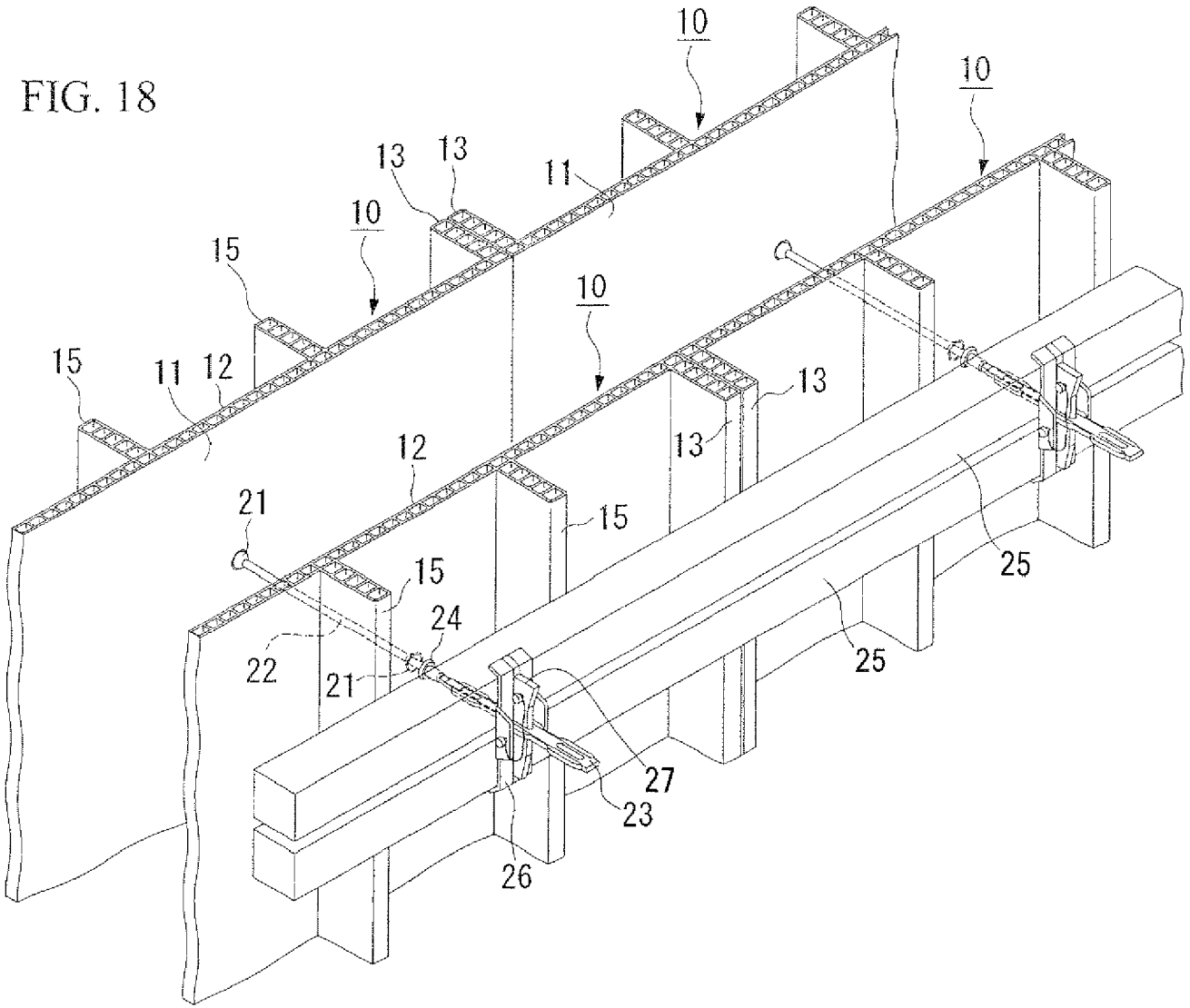
FIG. 18 is a perspective view showing an example of an installation configuration of a conventional form panel for placing concrete.

Next, the erection (installation) of this form panel for placing concrete of the present invention is described with reference to FIG. 16.

First, a plurality of form panels 70 are aligned in a row so that contact is achieved between the projecting sections 81 and between the projecting sections 82, each provided on the outside surfaces 78 of the side panel sections 73. Adjacent side panel sections 73 are temporarily secured using a clip fitting bent into a U-shaped cross-section (not shown in the Figure), and as shown in FIG. 14, an insertion hole for inserting a separator is then drilled through the contacting portions between the projecting sections 81 and the projecting sections 82 using a drill 91. A round rod-like separator 22 on which a P-Cone 21 is provided is then inserted into this insertion hole. Next, a clamp 23 is screwed onto the end of the separator 22 so that the width direction of the side panel sections 73 is sandwiched between the P-Cone 21 of the separator 22 and the template 24 at the base end of the clamp 23.

In the same manner, another row of a plurality of form panels 70 is aligned so that the concrete placing surfaces 71 oppose each other. An insertion hole for inserting the separator is then formed in the contacting portions between the projecting sections 81 and between the projecting sections 82, and the separator 22 is inserted into this insertion hole. Next, a clamp 23 is screwed onto the end of the separator 22 so that the width direction of the side panel sections 73 is sandwiched between the P-Cone 21 of the separator 22 and the template 24 at the base end of the clamp 23, thereby holding and supporting the form panels 70.

In the same manner, another row of a plurality of form panels 70 is aligned so that the concrete placing surfaces 71 oppose each other. An insertion hole for inserting the separator is then formed in the contacting portions between the projecting sections 81 and between the projecting sections 82, and the separator 22 is inserted into this insertion hole. Next, a clamp 23 is screwed onto the end of the separator 22 so that the width direction of the side panel sections 73 is sandwiched between the P-Cone 21 of the separator 22 and the template 24 at the base end of the clamp 23, thereby holding and supporting the form panels 70.

In addition, a pair of walers 25 made of square pipe steel are provided above and below the clamps 23, and are secured by a clip plate 26 and a wedge 27 which fastens the clip plate 26 in such a state that the walers 25 contact the side panel sections 73 and the side surface of the reinforcing panel sections 75. These walers 25 are provided to ensure that the form panel 70 does not expand outward due to the pressure of the concrete when the concrete is placed.

Because the form panel 70 described above is a plastic form panel for placing concrete, it has high durability, and can be recycled as plastic material after its useful life has been exceeded. Furthermore, because the form panel 70 is made of plastic, it has good concrete-releasing characteristics, making the use of concrete release agents unnecessary.

Furthermore, because the form panel 70 is made of plastic, and comprises the sheathing section 72, one side of which forms the concrete placing surface 71, and the hollow side panel sections 73 bent out at right angles from both side edges of the sheathing section 72 on the opposite side of the sheathing section 72 to the concrete placing surface 71, it is not necessary to perform nailing to secure the battens, which results in good workability, and no reduction in durability as a result of the nailing process. Such a form panel 70 can be reused many more times than a conventional plywood form panel.

Furthermore, in such a form panel 70, because two projecting sections 81 and 82 which extend in the vertical direction are provided on the outside surface 78 of the side panel section 73, when erecting the form panels 70, an insertion hole for inserting the separator can be formed in the contacting portions between the projecting sections 81 and between the projecting sections 82. Consequently there is no need for an insertion hole to be provided in the sheathing section 72.

Moreover, in such a form panel 70, because the clamping pressure produced by the P-Cone 21 of the separator 22 and the template 24 at the base end of the clamp 23 is borne across the width direction of the side panel section 73, the form panel 70 exhibits sufficient strength to withstand this pressure. Consequently, even when using formwork fittings in which pressure tends to concentrate on a single point, such as at the P-Cones 21 and clamps 23 used with conventional plywood form panels, the form panel 70 is not damaged.

Furthermore, because an inclined surface 83 is formed on the side surface of the projecting section 82 which faces the projecting section 81, when a plurality of form panels 70 are aligned in a row so that contact is achieved between the projecting sections 81 and between the projecting sections 82, each provided on the outside surfaces 78 of the side panel sections 73, the inclined surfaces 83 of the contacting projecting sections 82 face each other to form a groove 84 which acts as a guiding groove for the tip of a drill. Consequently, it is possible to reliably generate the insertion hole for inserting the separator, without the drill deviating sideways.

Moreover, in this form panel 70, since the length of the provided insertion holes can be shorter than in conventional form panels, in which the insertion grooves must be provided across the entire surface of the side panel section, forming the insertion holes is comparatively easy.

Furthermore, in this form panel 70, because the contacting area between the projecting sections, which represents the portions of the adjacent form panels 70 which are in contact, is less than in conventional form panels in which the entire surfaces of the side panel sections are in contact, it is less likely for gaps to form in the contacting portions of the projecting sections, and therefore less likely that concrete will leak out.

Moreover, in this form panel 70, since two projecting sections 81 and 82 which extend in the vertical direction are provided on the outside surfaces 78 of the side panel sections 73, when the form panel 70 is erected, a space 79 which is enclosed by the side panel sections 73 and the projecting sections 81 and 82 is formed between adjacent form panels 70. This space 79 can serve the function of collecting any concrete which leaks out from the contacting portion between the projecting sections 81 which adjoin on the concrete placing surface 71 side of the form panel 70, and consequently concrete does not leak outside the form panel 70.

Furthermore, in this form panel 70, because one of the side surfaces of one of the projecting sections 81 is coplanar with the concrete placing surface 71 of the sheathing section 72, the surface of the concrete placed after installing the form panel does not present irregularities where the form panels 70 are joined to each other, and the concrete surface can be kept flat.

Moreover, because reinforcing panel sections 75 which are parallel to the side panel sections 73 are provided on the rear surface 74 of the concrete placing surface 71 of the sheathing section 72, the durability and pressure tightness of the form panel 70 are further improved.

Furthermore, the sheathing section 72, the side panel section 73 and the reinforcing panel section 75 are hollow panels formed by integrating two panels 76 and a plurality of reinforcing ribs 77 connecting these panels. Consequently the form panel 70 is lightweight, and yet has sufficient mechanical strength. Specifically, because diagonal ribs 87 are formed in the sheathing section 72, the sheathing section 72 has high flexural strength, and when the concrete is poured, the sheathing section 32 is not bent by the pressure of the concrete.

The plastic form panel for placing concrete of the present invention is not limited to the construction shown in FIG. 12, and a construction in which the reinforcing ribs in the sheathing section 32 are all right angled ribs, or in which there is a fewer number of reinforcing panel sections 35, may also be used. Furthermore, when the width of the sheathing section is narrow, it is also possible to omit the reinforcing panel sections.

Moreover, the plastic form panel for placing concrete of the present invention is not limited to a construction in which the sheathing section 72, the side panel sections 73, the projecting sections 81 and 82 and the reinforcing panel sections75 are formed as an integrated unit by extrusion molding of a plastic material, as described above. For example, a process may be used in which a form panel main body is manufactured by forming the sheathing section 72, the side panel sections 73 and the reinforcing panel sections 75 as an integrated unit, and long tube shaped members are then attached to the outside surface 78 of these side panel sections73, either by fusing the members by heating, or by bonding the members using an adhesive, thereby forming the projecting sections 81 and 82.

Furthermore, provided projecting sections are provided on the outside surface of at least one of the side panel sections, projecting sections need not necessarily be provided on the outside surfaces of both of the side panel sections.

Moreover, the positions of the projecting sections are not restricted to the positions shown in the figures, and provided that one of the sides of one of the two vertical projecting sections is coplanar with the concrete placing surface of the sheathing section, the other projecting section need not be provided at the side edge of the side panel section as shown in the figures.

Furthermore, if the sheathing section is transparent or semitransparent, then light can pass through the form panel, allowing external light (sunlight) to enter a concrete placing site which is enclosed by form panels, eliminating the need for lighting.

Moreover, the separators used when erecting the form panels 70 are not limited to the round rod-like separators shown in the figures, and any known type of separator, such as flat separators, can be used.

A form panel for placing concrete of the present invention is a plastic form panel for placing concrete, comprising a hollow sheathing section, one side of which forms a concrete placing surface, and hollow side panel sections bent out at right angles from both side edges of the sheathing section, on the opposite side of the sheathing section to the concrete placing surface, wherein at least one projecting section which extends in the vertical direction is provided on the outside surface of at least one of the side panel sections, and one of the sides of one of the projecting sections is coplanar with the concrete placing surface of the sheathing section. Consequently the same formwork fittings as are used in conventional plywood form panels can be used during erection (installation), and furthermore the form panel is lightweight, has good workability, is highly durable, is resistant to the leaking of concrete, and is recyclable. Such a form panel is a very promising alternative to conventional plywood form panels, especially from an environmental standpoint.

The invention claimed is:

1. A form panel for placing concrete made of plastic comprising:

a hollow sheathing section, one side of which forms a concrete placing surface, hollow side panel sections bent out at right angles from both ends of said sheathing section on a side of said sheathing section opposite to said concrete placing surface, two hollow projecting sections, which extend in a vertical direction, provided on ends of an outside surface of at least one of said hollow side panel sections in a protruding manner toward the outside of said hollow side panel sections, each of said two hollow projecting sections having a length side surface and two width side surfaces, wherein one of said width side surfaces of one of said two hollow projecting sections is coplanar with said concrete placing surface of said sheathing section, a first diagonal rib which is diagonal relative to said concrete placing surface formed within said one of said two hollow projecting sections, wherein one of said two width side surfaces of said one of said two hollow projecting sections provided with said first diagonal rib is coplanar with said concrete placing surface of said sheathing section, and in contact with a corner, which is located on a distal end of said one of said two hollow projecting sections on said concrete placing surface of said sheathing section, and a second diagonal rib which is diagonal relative to said concrete placing surface formed within the other of said two hollow projecting sections, wherein one of the two width side surfaces of said the other of said two hollow projecting sections provided with said second diagonal rib is provided at a distal end surface of said hollow side and section, which is on the opposite side of the hollow sheathing section, and said second diagonal rib is in contact with a corner, which is located on a distal end of said the other of two hollow projecting sections on said distal end surface of said hollow side panel section, which is on the opposite side of the hollow sheathing section.

2. The form panel for placing concrete according to claim 1, wherein said sheathing section and said side panel sections are formed by integrating two panels and a plurality of long reinforcing ribs connecting these panels.

3. The form panel for placing concrete according to claim 1, wherein said two hollow projecting sections are made of a soft resin or a semi hard resin.

4. The form panel for placing concrete according to claim 1, wherein notches which are orthogonal to the longitudinal direction of said two hollow projecting sections are formed in the same position in each of said two hollow projecting sections.

5. The form panel for placing concrete according to claim 1, wherein a hollow reinforcing panel section which is parallel to said side panel sections is provided on an opposite side of said sheathing section to said concrete placing surface of said sheathing section.

6. The form panel for placing concrete according to claim 1, wherein said sheathing section is transparent or semitransparent.

7. The form panel for placing concrete according to claim 1, wherein said form panel is configured to form spaces between adjacent form panels for conserving leaked concrete, said spaces being formed by setting outer surfaces of said two hollow projecting sections in abutting contact with the outer surfaces of two other hollow projecting sections which extend in a vertical direction provided on both side edges of the outside surfaces of the side panel sections of adjacent form panels for placing concrete.

* * * * *